US005177545A

United States Patent [19]

Kato et al.

[11] Patent Number: 5,177,545

[45] Date of Patent: Jan. 5, 1993

[54] IMAGE FORMING APPARATUS HAVING AN IMPROVED CONTROL SYSTEM FOR A PAPER FEED TRAY

[75] Inventors: Tomokazu Kato; Syuzi Maruta, both of Toyokawa, Japan

[73] Assignee: Minolta Camera Kabushiki Kaisha, Osaka, Japan

[21] Appl. No.: 738,233

[22] Filed: Jul. 31, 1991

[30] Foreign Application Priority Data

Aug. 2, 1990 [JP] Japan ..... 2-206449

[51] Int. Cl.[5] ..... G03G 21/00

[52] U.S. Cl. ..... 355/309; 271/155; 355/321

[58] Field of Search ..... 355/308, 309, 321, 243; 271/152, 154, 155

[56] References Cited

U.S. PATENT DOCUMENTS 3,768,806 10/1973 Reehil ..... 271/155
3,820,777 6/1974 Reehil ..... 271/155
3,955,811 5/1976 Gibson ..... 355/309 X
4,332,375 6/1982 Tsubo ..... 271/9
4,466,604 8/1984 Kishimoto et al. ..... 271/155 X
4,477,178 10/1984 Furuichi et al. ..... 355/206
4,535,463 8/1985 Ito et al. ..... 377/8
4,860,055 8/1989 Ohira et al. ..... 355/308

FOREIGN PATENT DOCUMENTS 2229999 10/1990 United Kingdom ..... 271/152

*Primary Examiner*—A. T. Grimley
*Assistant Examiner*—William J. Royer
*Attorney, Agent, or Firm*—Burns, Doane, Swecker & Mathis

[57] ABSTRACT

An image forming apparatus such as a copying machine includes an image forming section for forming an image on a sheet of paper. In the image forming apparatus, a paper supporting member supports a stack of papers, and an elevator is provided for raising and lowering the paper supporting member. Further, a paper feeder feeds a sheet of paper from the paper supporting member to the image forming section. When an operation key is depressed, the image forming section is instructed to start forming an image. A controller controls the image forming section to form an image on a sheet of paper when the paper feeder can feed a sheet of paper if the operation key is depressed during rising of the paper supporting member.

9 Claims, 33 Drawing Sheets

S4
Process by paper feed tray selection key
S20
APS flag = 0 ?
NO
YES
S21
Selection key 731 ON ?
NO
YES
S33
LCT selected ?
NO
YES
S22
Tray 42 selected ?
NO
B
YES
S34
Empty signal=1?
NO
YES
A
S23
Tray 43 selected
S24
Turn OFF Display LED800
S25
Turn ON Display LED801
C
S36
Reset paper empty flag
S35
Set paper empty flag
S37
Process to set paper size
D G
S80
Mismatching flag = 1?
YES
NO
S81
Copy start flag ← 0
S82
Copy start flag = 1 ?
NO
YES
S83
Main motor ON
Developing motor ON
Corona charger ON
Transfer charger ON
Copy start flag ← 0
Set Timer A
Set Timer B
S84
Tray 43 selected ?
NO
J
YES
S85
Turn ON Paper feed rollers for tray 43
K

M

S97
Return flag = 1?
NO
YES
S98
Multi-copy completed?
NO
YES
S99
Document position signal = 1?
NO
YES
S101
Copy start flag ← 1
Return flag ← 0
Turn OFF developing motor
Turn OFF charger
Set Timer D
Return flag ← 0
S100
S102
Timer D completed?
NO
YES
S103
Turn OFF Main motor
Return S6
Automatic paper selecting process S111
APS flag = 1
NO
N
YES
S112
A register ← Document size data
S113
Paper size of tray41 = A register ?
NO
YES
S114
Paper size of tray43 = A register ?
NO
O
YES
S116
Mismatching flag ← 0
S118
Mismatching flag ← 0
S117
Tray 42 selected
Turn ON display LED800
Turn OFF display LEDs 801, 802
S119
Tray 41 selected
Turn ON display LED 801
Turn OFF display LEDs 800, 802
S123
Process to set paper size
P O
S115
Paper size of LCT=A register ?
NO
YES
S120
Mismatching flag ←0
S122
Mismatching flag ←1
S121
LCT Selected
Turn ON display LED 802
Turn OFF display LEDs 800, 801
P
S124
LCT selected ?
NO
YES
S125
Empty signal =1 ?
NO
YES
S126
Set paper empty flag
S127
Reset paper empty flag
S128
Display selected paper size
N
Return

IMAGE FORMING APPARATUS HAVING AN IMPROVED CONTROL SYSTEM FOR A PAPER FEED TRAY

BACKGROUND OF THE INVENTION

1. Field of the Invention

The present invention relates to an image forming apparatus, and more particularly, to an image forming apparatus such as a copying machine or the like which is provided with a paper feed tray having an elevator that can move up and down between lowest position and a paper feed position positioned above the lowest position, so that paper is set on the elevator when the elevator is at the lowest position, and is fed to the image forming apparatus when the elevator is at the paper feed position.

2. Description of the Related Art

A copying machine has been known to those skilled in the art to be provided with a paper feed tray (referred to as an LCT hereinafter) for storing a plenty of copying papers with up-and-down movements of an elevator for setting them thereon.

In this kind of the copying machine, the LCT is raised by an elevator to a paper feed position when the power switch is turned ON, and lowered to the lowest position or a paper supply position in which papers are supplied to the LCT, when the power switch is turned OFF. Moreover, when a cover of the LCT is opened and an elevator down key is depressed to supply paper to be copied onto the elevator within the LCT, the elevator is lowered to the lowest position. Thereafter, when the cover of the LCT is closed after being supplied with paper, the elevator is automatically raised to the paper feed position.

In such a conventional copying machine described as above, it is impossible to feed the paper from the LCT while the elevator is driven, namely, moving up and down. Therefore, the copying machine at this occasion is forced into a paper empty state, that is, in a state lack of papers in the LCT.

Even if a print key is depressed after depressing a key for selecting the LCT in order to perform a copying operation during rising of the elevator, it may be in a paper empty state. Then, the LCT can not be selected. In order to start the copying operation, it is necessary to depress the print key again after waiting until the elevator reaches the paper feed position. In this case, it takes a long time to operate the copying machine and perform the copying operation.

Furthermore, when the print key is manipulated during the rising time of the elevator in an automatic paper selecting mode (referred to as an APS mode hereinafter), even if the size of the paper set in the LCT is proper to a document, the LCT is switched to another tray because of the above-mentioned paper empty state. Therefore, it sometimes happens that copying is achieved on a paper of an improper size.

SUMMARY OF THE INVENTION

An object of the present invention is therefore to provide an image forming apparatus such as a copying machine or the like, with an aim to substantially eliminate the abovedescribed disadvantages inherent in the prior art, whereby when a desired paper feed tray is selected to start an image forming operation, the image forming operation is kept waiting during the rise of an elevator until the elevator of the paper feed tray reaches a paper feed position, without setting the tray in the empty state.

In order to achieve the aforementioned objective, according to one aspect of the present invention, there is provided an image forming apparatus comprising:

image forming means for forming an image on a sheet of paper;

a paper supporting member for supporting a stack of papers;

elevator means for raising and lowering said paper supporting member;

paper feeding means for feeding a sheet of paper from said paper supporting member to said image forming means;

operating means for instructing said image forming means to start forming an image; and control means for controlling said image forming means to form an image on a sheet of paper when said paper feeding means can feed a sheet of paper if said operating means instructs said image forming means to start forming an image during rising of said paper supporting member.

According to another aspect of the present invention, there is provided an image forming apparatus comprising:

image forming means for forming an image of a document on a sheet of paper with a predetermined one of plural magnifications;

at least first and second paper feeding means for storing and feeding papers of different sizes, respectively, said first paper feeding means including a paper supporting member for supporting a stack of papers and elevator means for raising and lowering said paper supporting member;

size detection means for detecting a size of said document;

paper size judgment means for judging a paper size suitable for forming said image of said document based on said size of said document detected by said size detection means;

selection means for selecting one of said first and second paper feeding means suitable for forming said image of said document based on said paper size judged by said paper size judgment means; and control means for controlling said image forming means to form said image of said document on a sheet of paper when said image forming means can form said image after if said first paper feeding means is selected by said selection means during rising of said paper supporting member.

According to a further aspect of the present invention, there is provided an image forming apparatus comprising:

image forming means for forming an image of a document on a sheet of paper with a predetermined one of plural magnifications;

at least first and second paper feeding means for storing and feeding papers of different sizes, respectively, said first paper feeding means including a paper supporting member for supporting a stack of papers and elevator means for raising and lowering said paper supporting member;

selection means for selecting either one of said first and second paper feeding means; and control means for controlling said paper feeding means to start feeding a sheet of paper immediately after said paper supporting member reaches a predetermined position if said first paper feeding means is selected by said selection means during rising of said paper supporting member.

Accordingly, even when the image forming process is ordered during the rising time of the elevator, the image forming apparatus is prevented from being set in the paper empty state, but kept in the standby state.

Accordingly, for example, when the image forming process is ordered during the rising time of the elevator in the APS mode, and the size of papers set in the paper feed tray is detected and selected to be proper to the document, it can be prevented that the paper feed tray is switched to the other tray.

BRIEF DESCRIPTION OF THE DRAWINGS

This and other objects and features of the present invention will become apparent from the following description taken in conjunction with one preferred embodiment thereof with reference to the accompanying drawings, in which.

DETAILED DESCRIPTION OF THE PREFERRED EMBODIMENT

Figure 1A:
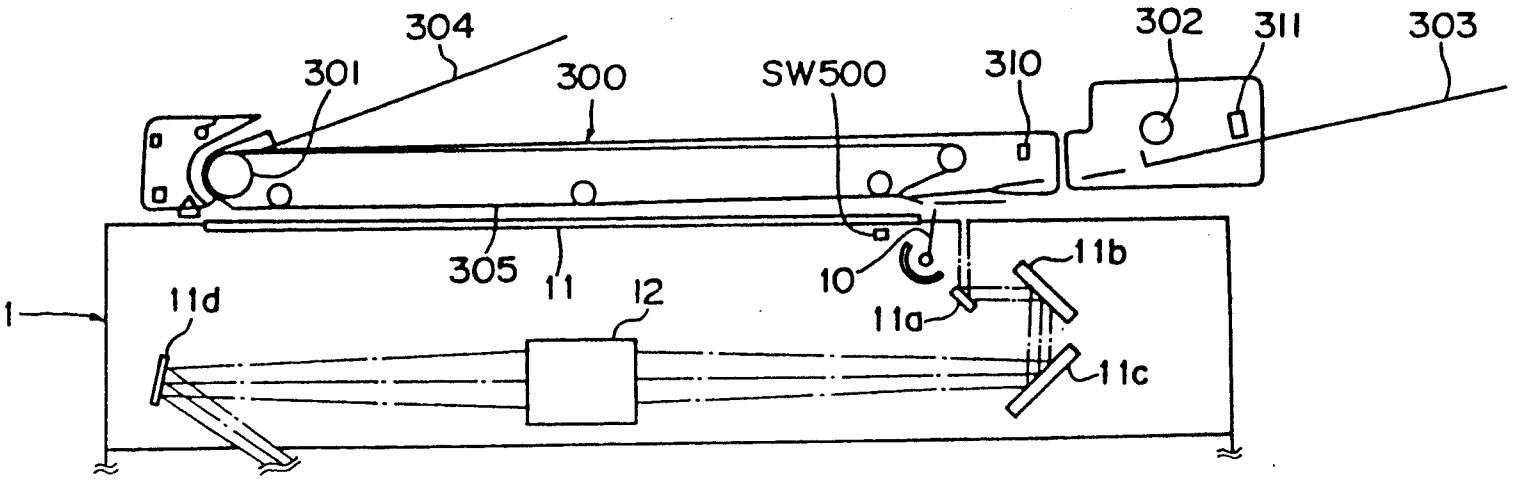
FIGS. 1*a* and 1*b* are cross sectional views of a mechanism part of an electrophotographic copying machine according to one preferred embodiment of the present invention.

Before the description of the present invention proceeds, it is to be noted here that like parts are designated by like reference numerals throughout the accompanying drawings.

An electrophotographic copying machine according to one preferred embodiment of the present invention will be described hereinbelow in the order of the following items:

(a) construction of the copying machine
(b) operating panel
(c) construction of each controlling part
(d) operation of a main body of the copying machine
(e) operation of an LCT driving device
(f) operation of an automatic original transferring device The electrophotographic copying machine according to the instant embodiment is provided with an LCT driving device 1000 which has an LCT 1030 with an elevator 1020. During the rise of the elevator 1020 of the LCT 1030 (elevator up signal = 1), the copying machine is not set in the paper empty state, unlike a conventional one. When LCT 1030 is selected and a print key 721 is depressed, the copying machine is set in a standby state (copy standby flag = 1). Further, when the elevator 1020 is raised to a paper feed position and an upper surface switch 1002 is turned ON thereby turning the elevator up signal to 0, a copy start flag is set to 1, with the copy standby flag being reset to 0. As a result, the copying operation is started onto a copying paper set in the selected LCT 1030.

(a) Construction of the Copying Machine

Figure 1B:
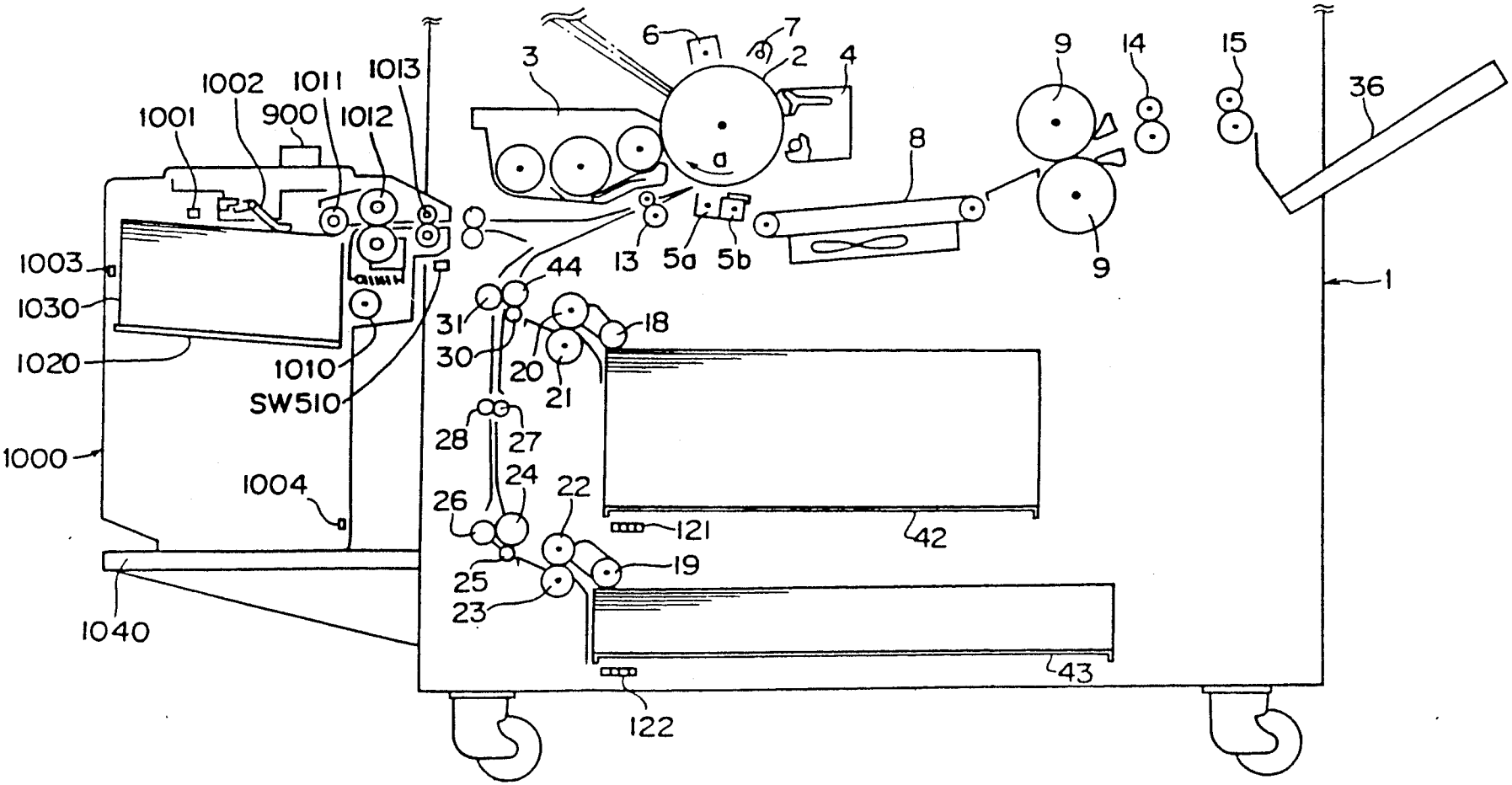

FIGS. 1*a* and 1*b* are cross sectional views of a mechanism part of the electrophotographic copying machine of the one preferred embodiment, wherein FIG. 1*a* shows an upper part of the copying machine and FIG. 2*a* shows a lower part thereof.

As shown in FIGS. 1*a* and 1*b*, the copying machine is constituted by a main body 1, an automatic document feeding device (referred to as an ADF device hereinafter) 300 which is provided as an option, and an LCT driving device 1000.

A copying mechanism of the main body 1 may be identical to that of a conventional electrophotographic copying machine, which will be briefly depicted hereinbelow.

A photosensitive drum 2 is provided in the central part of the main body 1 to be rotatable in a counterclockwise direction. Moreover, an eraser lamp 7, a corona charger 6, a developing device 3, a transfer charger 5*a*, a separating charger 5*b* for separating a transfer paper from the photosensitive drum 2 and a blade-type cleaner device 4 are provided around the photosensitive drum 2 in this order in the counterclockwise direction. The photosensitive drum 2 has a photoreceptor such as selenium or the like on the surface thereof. On every copying operation the photosensitive drum 2 is irradiated by the eraser lamp 7, charged by the charger 6 and receives an image exposure from an optical system which will be described below.

The optical system is beneath an original glass 11 and consists of a light source 10, a first mirror 11*a*, a second mirror 11*b*, a third mirror 11*c*, a projecting lens 12 and a fourth mirror 11*d*. An image of an original document placed on the glass 11 is, as indicated by one-dot chain line in FIG. 1, formed on the photosensitive drum 2 through the mirrors 11*a*–11*c*, the projecting lens 12 and the mirror 11*d*. A fixed position switch SW500 is provided for detecting whether the optical system is at a predetermined position when the system scans. For example, in the case of the equal size copying, the light source 10 and the first mirror 11*a* are moved toward the left in FIG. 1 with the same speed as a peripheral velocity of the photosensitive drum 2 consequent to the rotation of the drum 2. At the same time, the second and third mirrors 11*b* and 11*c* are moved toward the left with the speed half the peripheral velocity of the photosensitive drum 2. The image of the document is exposed into a slit on the photosensitive drum 2 from the fourth mirror 11*d* as the mirrors etc. are moved.

There are provided two paper feed trays, i.e., an upper paper feed tray 42 and a lower paper feed tray 43 in the main body 1 of the copying machine. On the transferring operation, a copying paper is transferred to a timing roller 13 from the paper feed tray 42 or 43, or the LCT driving device 1000, and then, is fed to a transferring part by the timing roller 13. In other words, copying papers set on the upper paper feed tray 42 are picked up one by one by a paper feed roller 18 and transferred to the timing roller 13 by unraveling rollers 20 and 21 and transfer rollers 30, 31 and 44. On the other hand, copying papers set on the lower paper feed tray 43 are picked up one by one by a paper feed roller 19, and then sent to the timing roller 13 by unraveling rollers 22 and 23 and transfer rollers 24, 25, 26, 27, 28, 31 and 44.

The copying paper fed to the transferring part is in tight contact with the photosensitive drum 2. After a toner image is transferred onto the copying paper through corona discharge of the transfer charger 5*a*, the copying paper is separated from the photosensitive drum 2 by the corona discharge of the separating charger 5*b* and the firmness of the paper itself. The copying paper is further attracted onto a transfer belt 8 equipped with an air suction means and transferred toward the right of FIG. 1 in accordance with the rotation of the belt 8 in a clockwise direction. Then, the toner image on the copying paper is, when the copying paper passes a fixing device 9, melted and fixed. Thereafter, the copying paper is discharged onto a discharge tray 36 by discharging rollers 14 and 15.

Paper size detecting switches 121 and 122 each comprised of switches SW1, SW2, SW3 and SW4 are provided in the vicinity of paper feed ports of the respective paper feed trays 42 and 43. Each detecting switch detects the size of the copying papers set on the corresponding paper feed tray 42 or 43 and in which direction, widthwise or lengthwise direction, the copying papers are set toward a paper feed direction. According to the instant embodiment, copying papers of the size A3, A4, A5, B4 and B5 are possible to be copied, that is, possible to be set on the paper feed trays 42 and 43. And, it is possible to select the setting direction, widthwise or lengthwise, only for the papers of A4 and B5. The paper size detecting switches 121 and 122 detect also whether the respective paper feed trays are mounted or detached. Accordingly, the presence or absence of the copying papers at the paper feed ports of the trays 42 and 43 can be detected indirectly. The size and setting direction of the copying papers are detected by a four-bit code corresponding to a combination of the ON/-OFF states of the switches SW1–SW4 of each switch 121 or 122, as shown in Table 1. The size and setting direction of the copying papers are stored in a RAM 213 within a controlling part of the main body which will be described later. In Table 1, the ON state of each switch SW1, SW2, SW3 or SW4 is represented by 1, while the OFF state thereof is designated by 0. When all of the four switches SW1–SW4 are in the OFF state, it means that the paper feed tray is not mounted at the paper feed port, or the copying papers are not set on the paper feed tray.

The LCT driving device 1000 is provided for supplying only the copying papers of A4 size set in an LCT 1030 one by one to the main body 1. The LCT driving device 1000 is provided movable on a rail 1040 and detachably coupled to the side face of the main body 1 by a coupling member (not shown). A docking detecting switch SW510 within the main body 1 detects whether the LCT driving device 1000 is coupled with the main body 1 by the coupling member.

Within the LCT driving device 1000 are provided a paper detecting sensor 1001, an upper surface switch 1002, an LCT cover switch 1003 and a lower surface sensor 1004. The paper detecting sensor 1001 optically detects whether the copying paper is set on the LCT elevator 1020 onto which the copying papers of A4 size should be set. The upper surface switch 1002 detects whether an upper surface of the uppermost copying paper among the copying papers set on the LCT elevator 1020 reaches a predetermined paper feed position. Further, the LCT cover switch 1003 detects opening and closing of an LCT cover (not shown) which covers the inside of the LCT driving device 1000 and is opened and closed when the copying papers are supplied thereto. Meanwhile, the lower sensor 1004 detects whether the LCT elevator 1020 reaches a predetermined lowest position.

Copying papers set on the LCT elevator 1020 within the LCT driving device 1000 are fed into the main body 1 one after another by a paper feed roller 1011 and transfer rollers 1012 and 1013. The LCT elevator 1020 is raised or descended by an elevator motor 1010.

In the ADF device 300, it is checked by a document sensor 310 whether the document is fed, and a document detecting sensor 311 detects whether the document is present on a document tray 303. A transfer belt motor 301 rotates a document transfer belt 305 of the ADF device 300 in a clockwise direction. A document feed motor 302 supplies the document from the document tray 303 to a predetermined position on the document glass 11. After the image of the document is read, the document is discharged to a discharge tray 304.

(b) Operating Panel

Figure 2:
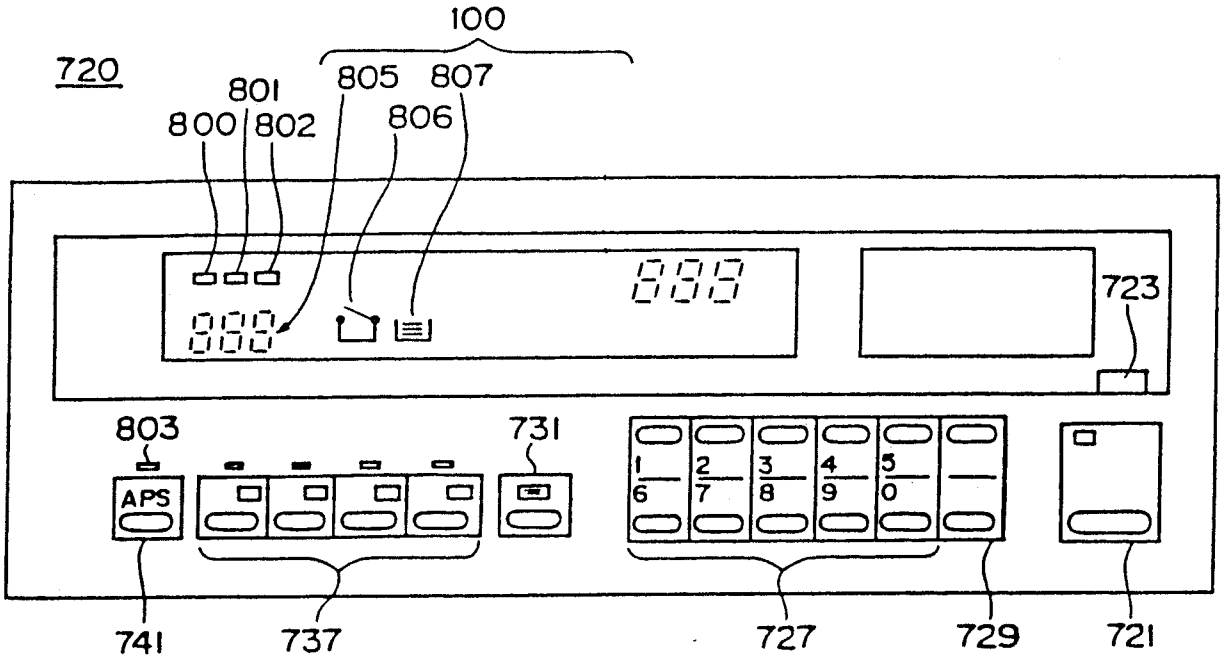
FIG. 2 is a front elevational view of an operating panel of the copying machine of FIG. 1.

FIG. 2 shows a front elevational view of an operating panel 720 of the copying machine of FIG. 1.

As shown in FIG. 2, there are various keys in the lower part on the operating panel 720. Besides a print key 721 for starting copying, there are a ten key 727 for inputting the number of sheets to be copied, a clear key 729 for clearing the input number of sheets, a tray selection key 731 for selecting one of the upper and lower paper feed trays 42 and 43 and LCT 1030, a magnification selection key 737 for selecting a copying magnification, namely, equal size, fixed reduction in two steps and fixed enlargement in one step, an all reset key 723 for initializing the copying mode, an automatic paper selection key 741 (referred to as an APS key hereinafter) for setting the APS mode to automatically select the copying paper.

A display part 100 of a fluorescent tube as well as four light emitting diodes 800, 801, 802 and 803 (referred to as an LED hereinafter) is provided in the upper part of the operating panel 720. The display part 100 is provided with a paper size display part 805, an improper setting display part 806 for indicating improper setting, and a paper empty display part 807. An LED 800 is a display LED for indicating that the upper paper feed tray 42 is selected, while an LED 801 is a display LED for indicating that the lower paper feed tray 43 is selected. Moreover, an LED 802 is an LED for indicating that LCT 1030 is selected. An LED 803 indicates that APS is selected.

Figure 3:
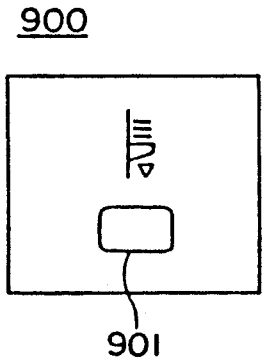
FIG. 3 is a front elevational view of an operating panel of an LCT driving device of FIG. 1.

FIG. 3 is a front elevational view of an operating panel 900 provided on an upper surface of the LCT driving device 1000 of FIG. 1*b*. This operating panel 900 has an elevator down key 901 to show that the LCT elevator 1020 is descended.

(c) Construction of Each Controlling Part

Figure 4A:
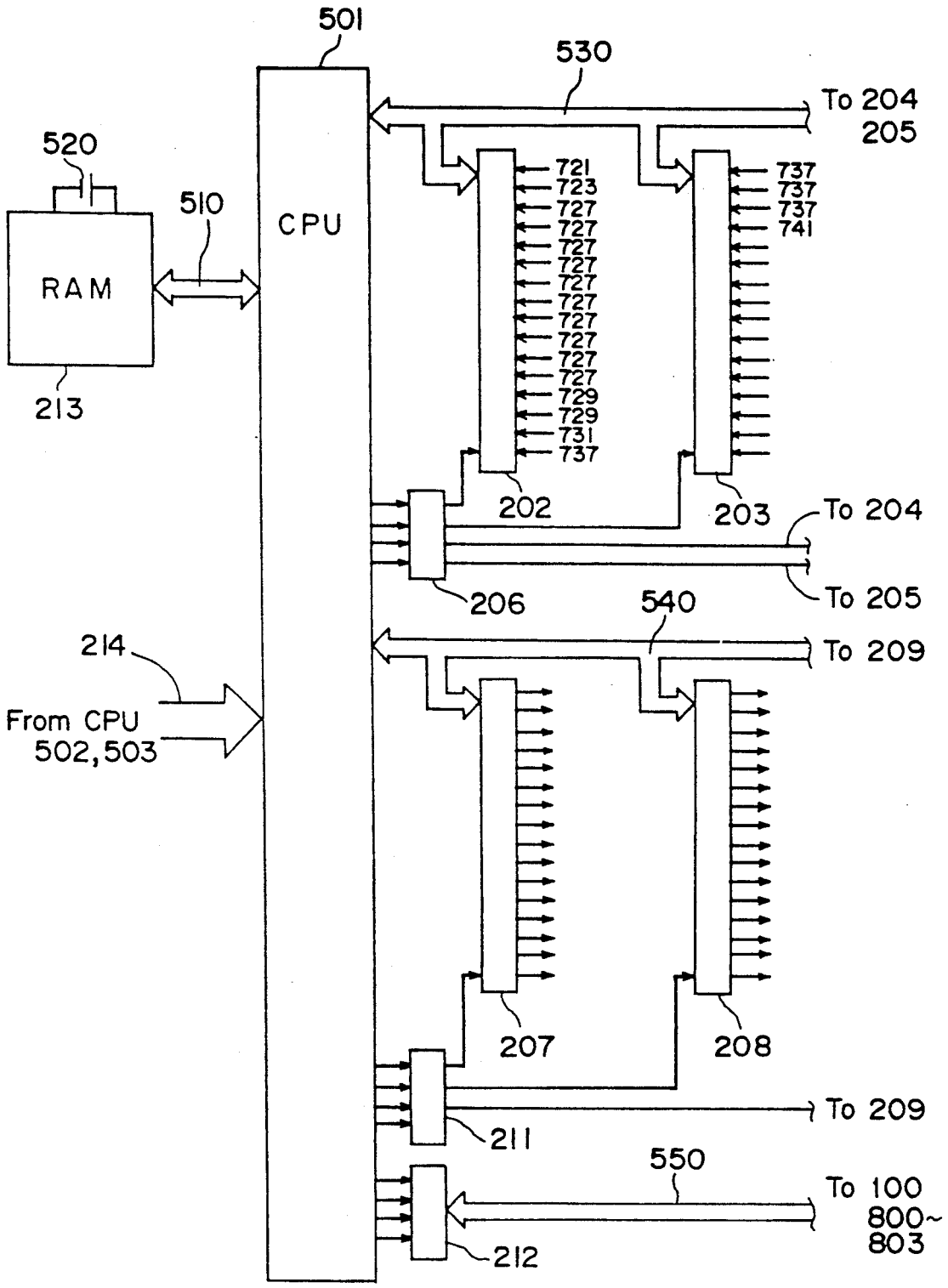
FIGS. 4*a* and 4*b* are block diagrams of a controlling part of a main body of the copying machine of FIG. 1.
Figure 4B:
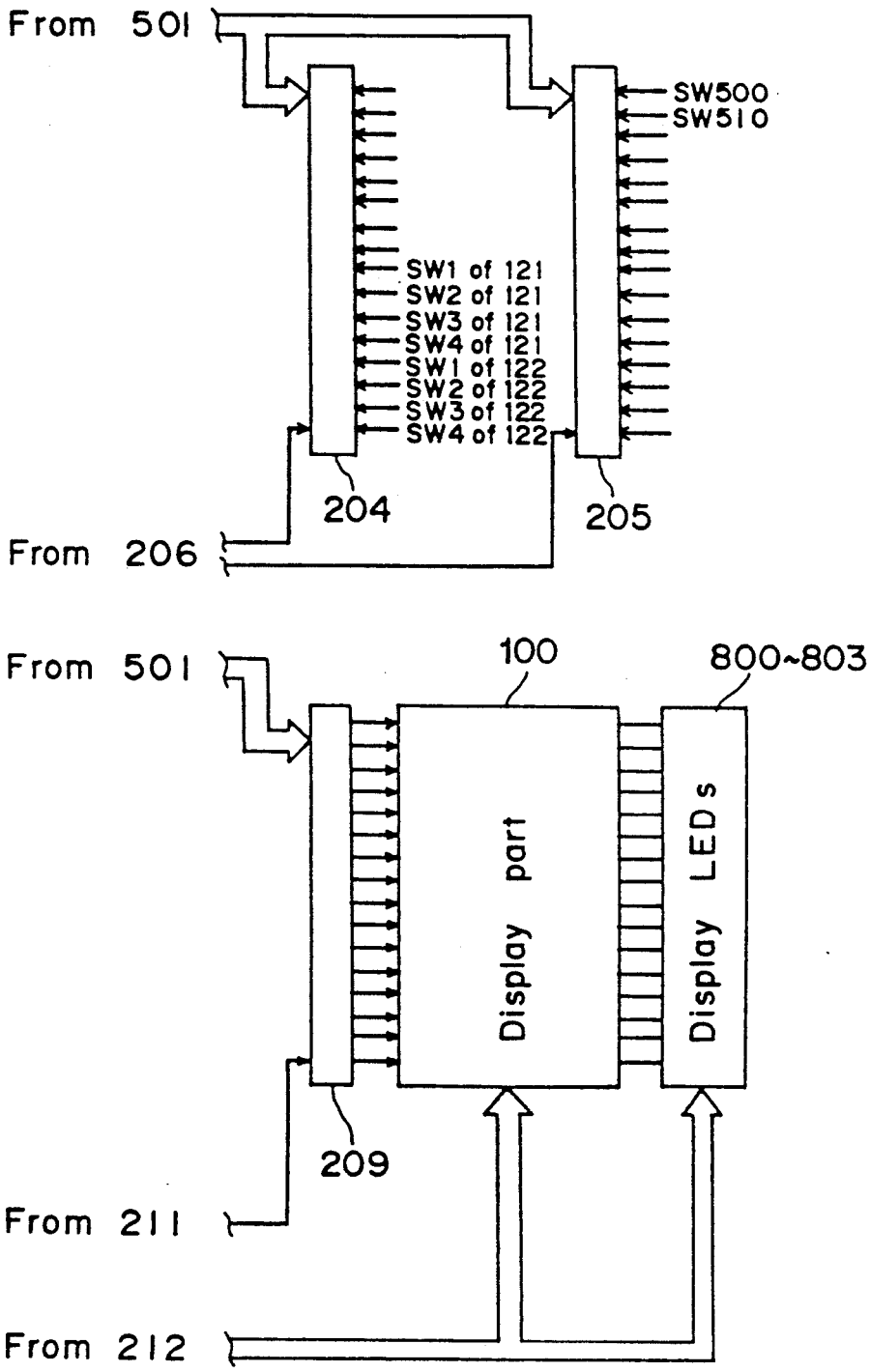

FIGS. 4*a* and 4*b* are block diagrams of a controlling part for controlling the main body 1.

The controlling part is provided with a CPU 501 which controls the operation of the main body 1. The CPU 501 is connected with a RAM 213 which is backed up by a battery 520 via a bus 510.

Integrated circuits 202–205 are used as input interface circuits, which are connected to the CPU 501 via a data line 530 and controlled via a decoder 206. To input terminals of the integrated circuits 202–205 are connected various keys and switches shown in FIGS. 4*a* and 4*b*. On the other hand, integrated circuits 207–209 are used as output interface circuits, and connected to the CPU 501 via a data line 540 and controlled via a decoder 211. Output terminals of the integrated circuits 207–209 are connected with various component parts, the devices, the display part 100 and the display LEDs 800–803 shown in FIGS. 4*a* and 4*b*. The display part 100 and the display LEDs 800–803 are controlled by the CPU 501 through a decoder 21 via a bus 550.

The CPU 501 is further connected to the other CPUs 502 and 503 via a bus 214 for communications therebetween.

Figure 5:
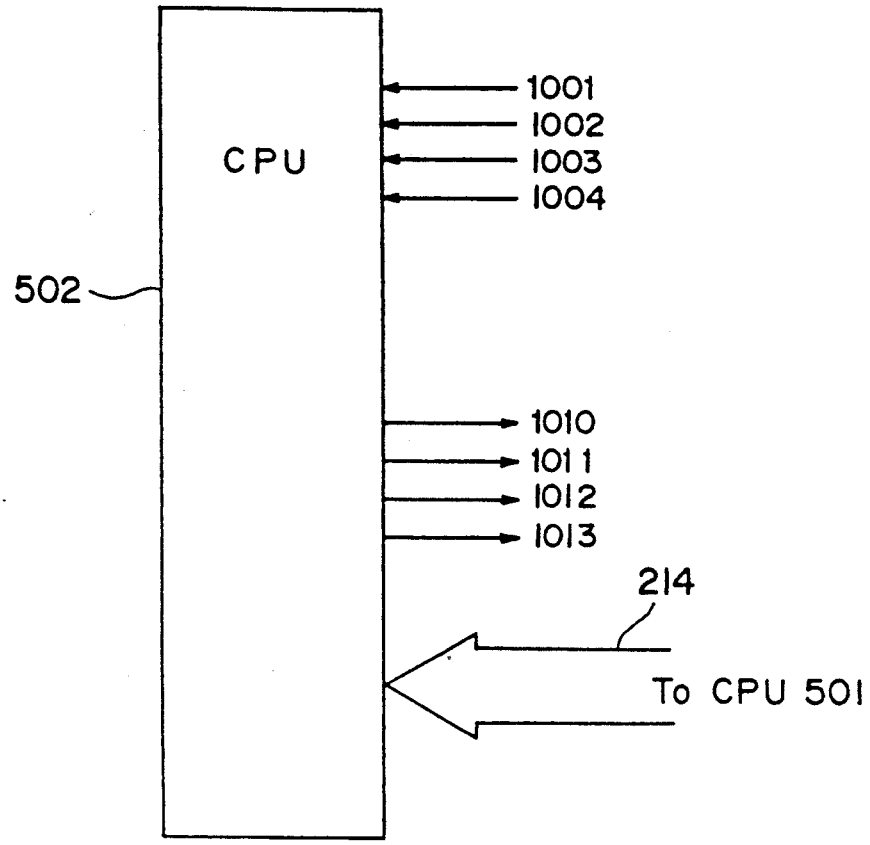
FIG. 5 is a block diagram of an LCT controlling part of the LCT driving device of FIG. 1.

FIG. 5 is a block diagram of an LCT controlling part for controlling the LCT driving device 1000. The LCT controlling part is provided with the CPU 502 referred to above to control the operation of the LCT driving device 1000. Detecting signals from the paper detecting sensor 1001, the upper surface switch 1002, the cover switch 1003 and the lower sensor 1004 are inputted to the CPU 502, and controlling signals are outputted from the CPU 502 to the paper feed roller 1011, the transfer rollers 1012, 1013 and the elevator motor 1010. The CPU 502 is connected with the CPU 501 via the bus 214 as described earlier.

Figure 6:
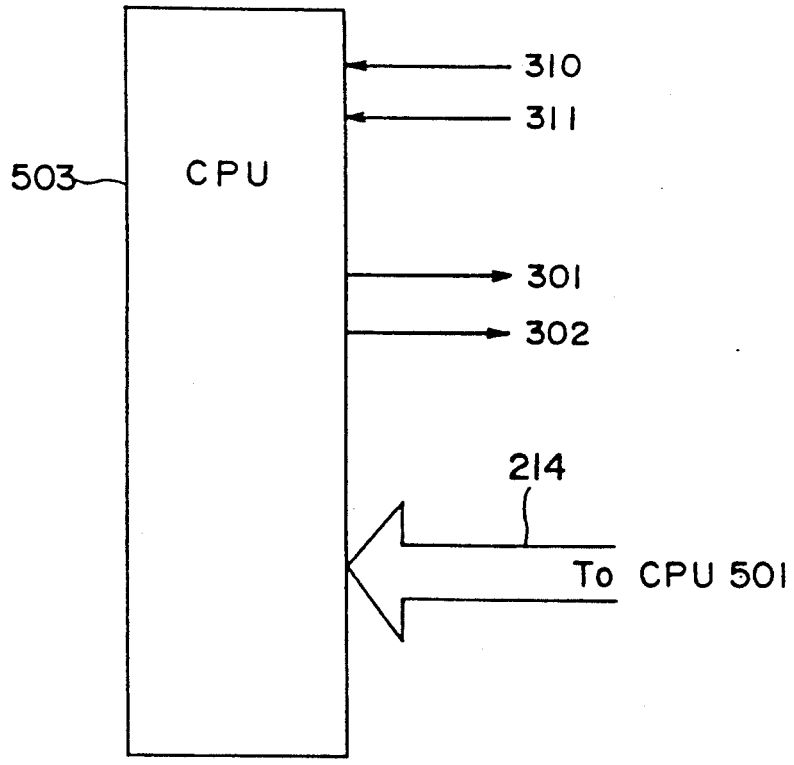
FIG. 6 is a block diagram of an ADF controlling part of an ADF device of the copying machine of FIG. 1.

FIG. 6 is a block diagram of an ADF controlling part for controlling the ADF device 300. The above-mentioned CPU 503 is provided in this ADF controlling part, to which detecting signals from the document sensor 310 and the document detecting sensor 311 are inputted, thereby outputting controlling signals to the transfer belt motor 301 and the document feed motor 302. The CPU 503 is connected to the CPU 501 via the bus 214.

(d) Operation of Main Body of Copying Machine

Figure 7:
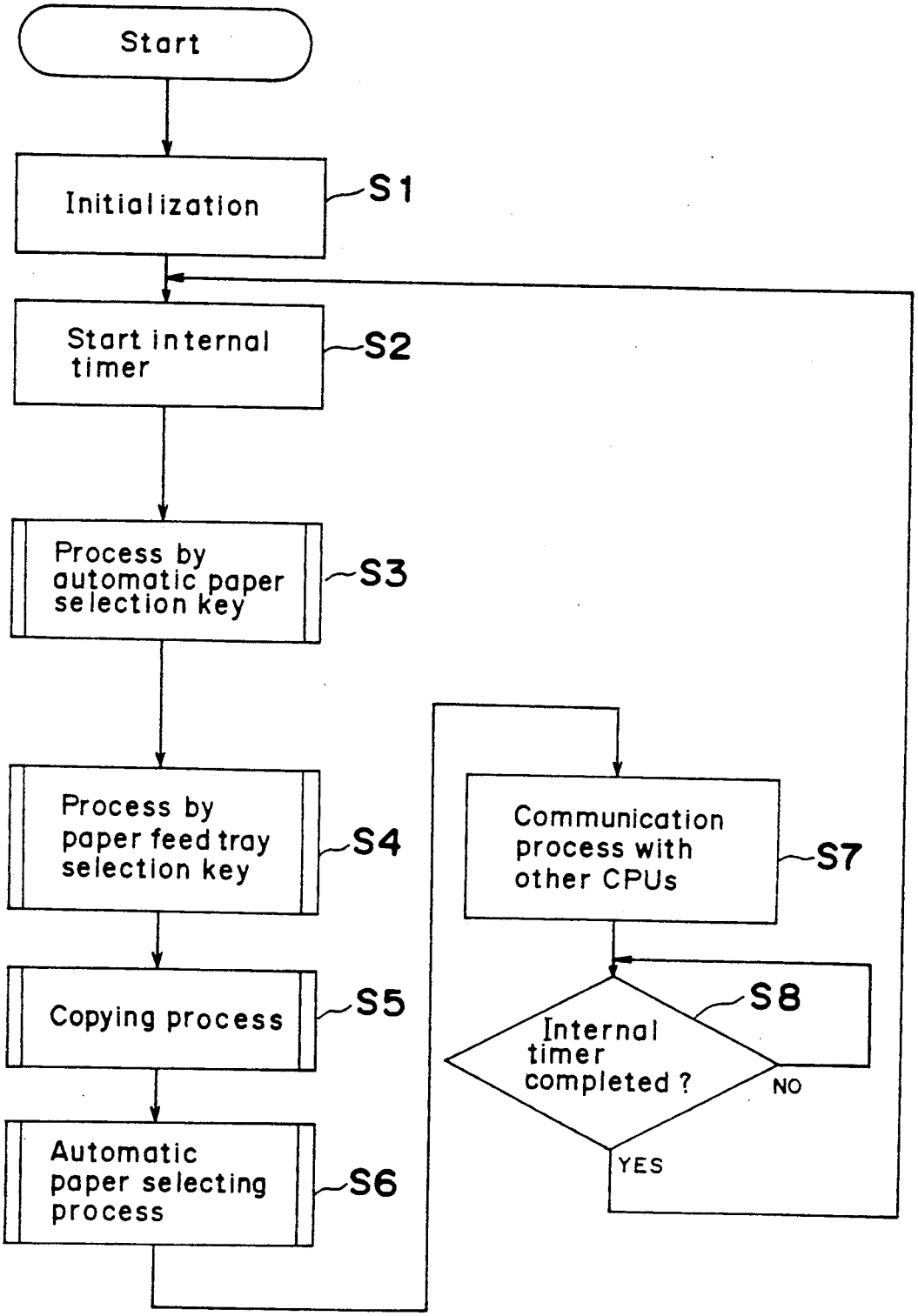
FIG. 7 is a flow chart of a main routine of the controlling part of FIG. 4*a*.

FIG. 7 is a flow chart showing a main routine of the CPU 501 shown in FIG. 4 for controlling the main body 1 of the copying machine.

When the main body 1 is turned ON or the all reset key 723 is turned ON, the CPU 501 is reset to start a processing program of the main routine. At step S1, initialization process is conducted that is, data stored in RAM 213 is cleared, various registers and the CPU 501 are initialized, and the main body 1 is set in the initial mode, etc. At step S2, an internal timer incorporated in CPU 501 and set at a predetermined value beforehand in the initialization process is started.

In the following steps S3, S4, S5 and S6, a process by an automatic paper selection key, a process by a paper feed tray selection key, a copying process and an automatic paper selecting process are carried out sequentially. At step S7, CPU 501 communicates with the other CPUs 502, 503 via the bus 214. If it is found at step S8 that the internal timer is complete (YES at step S8), one routine is finished, and the program flow is returned to step S2.

Figure 8:
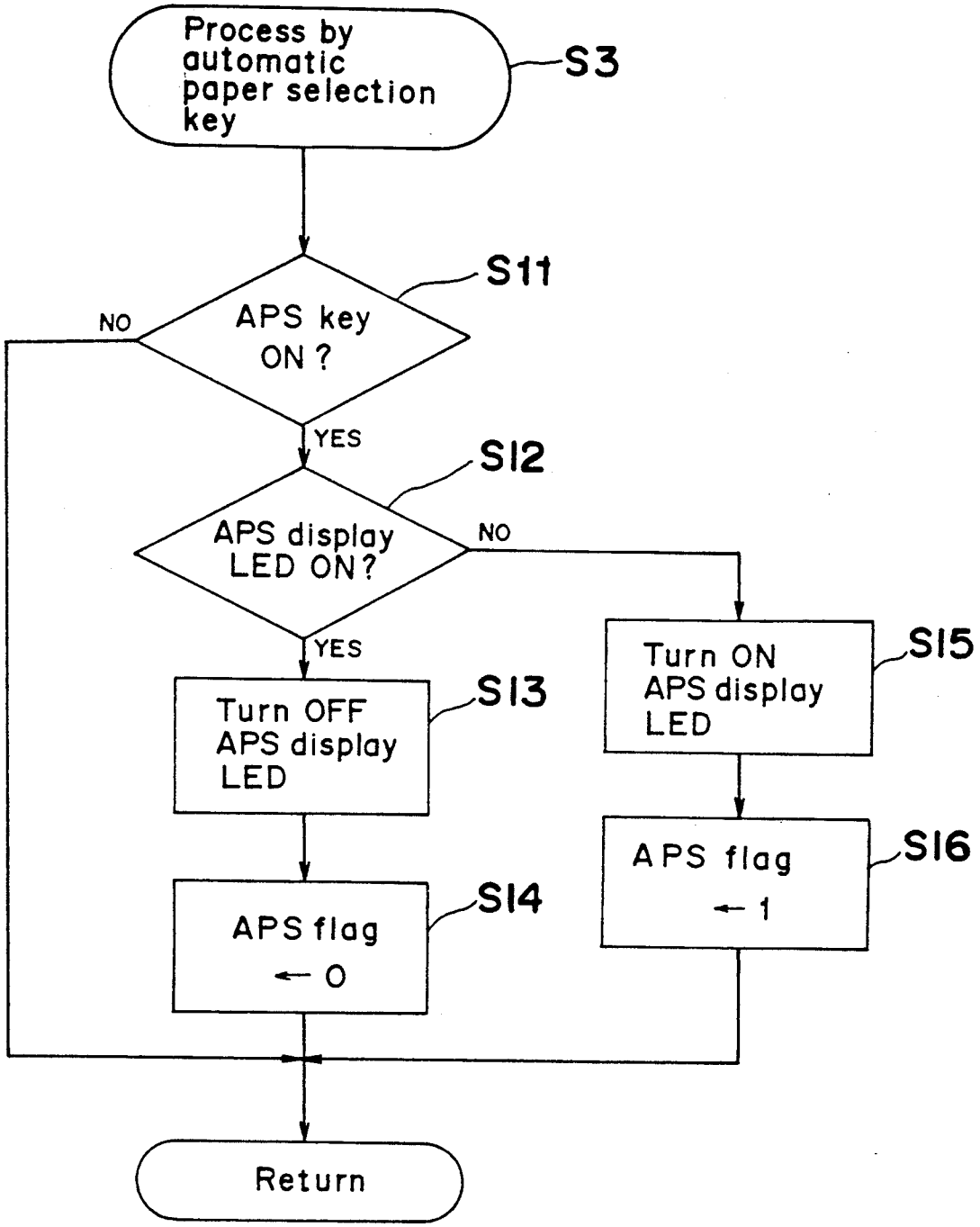
FIG. 8 is a flow chart of a process by an automatic paper selection key of FIG. 7.

FIG. 8 is a flow chart showing the process by the automatic paper selection key in FIG. 7 (step S3).

In the first place, it is detected at step S11 whether the APS key 741 is turned ON, and at step S12 whether the APS display LED 803 is turned ON.

When the APS key 741 is turned ON (YES at step S11), step S12 checks whether the APS display LED 803 is in ON condition. When the APS display LED 803 is in ON condition, the APS display LED 803 is turned OFF at step S13. After the APS flag is reset to 0 at step S14, the program flow is returned to the main routine. On the other hand, when the APS key 741 is turned ON (YES at step S11) but the APS display LED 803 is OFF (NO at step S12), the APS display LED 803 is turned ON at step S15, and the APS flag is set to 1 at step S16. Thereafter, the program flow is returned to the main routine.

Meanwhile, when the APS key 741 is not ON at step S11 (NO at step S11), the program flow is immediately returned to the main routine.

Figure 9A:
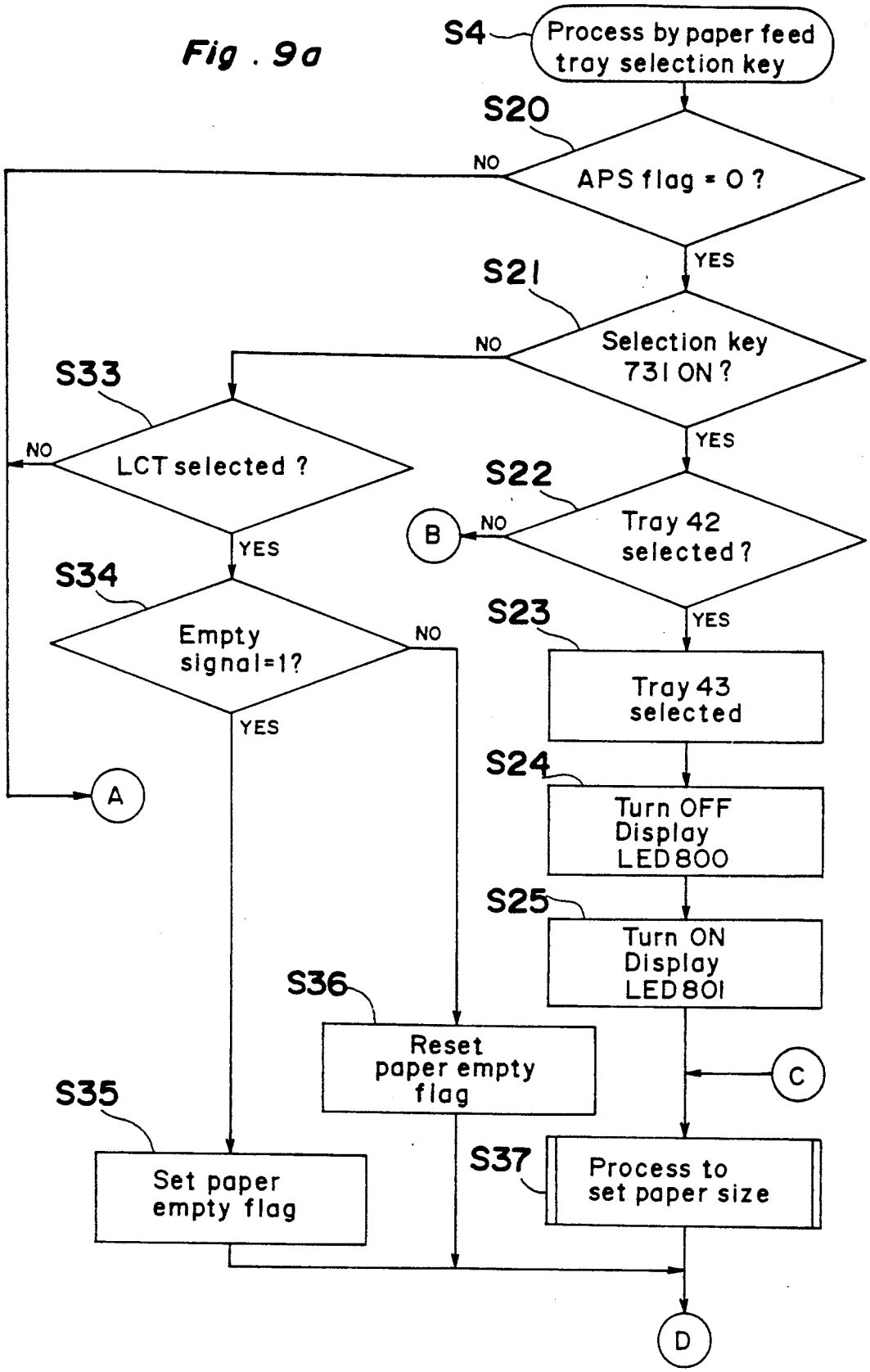
FIGS. 9*a* and 9*b* are flow charts of a process by a paper feed tray selection key of FIG. 7.
Figure 9B:
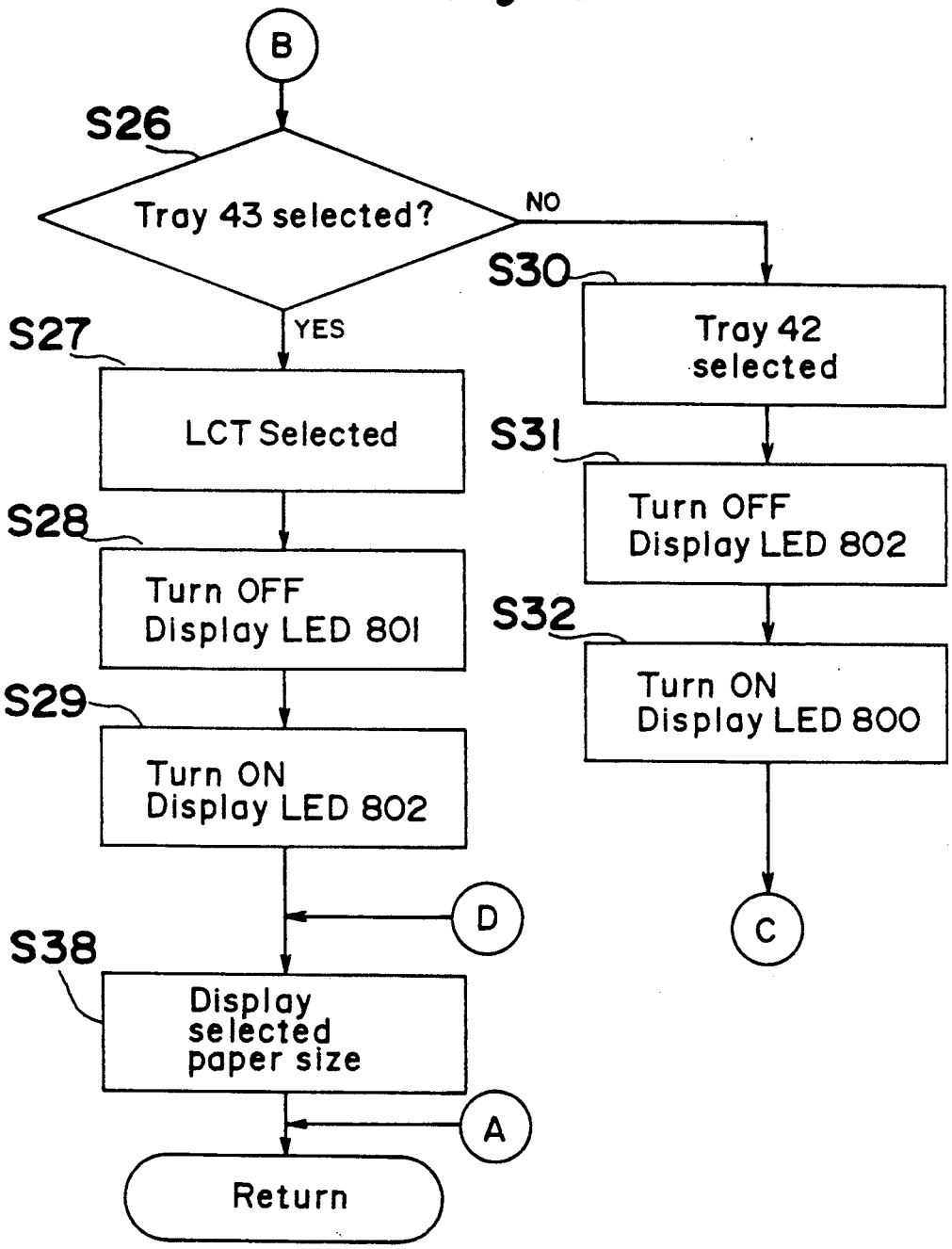

FIGS. 9*a* and 9*b* are flow charts showing the process by the paper feed tray selection key of FIG. 7 (step S4).

Referring to FIG. 9*a*, it is detected at step S20 whether the APS flag is 0 and it is also detected at step S21 whether the paper feed tray selection key 731 is turned ON. If the APS flag is not 0 (NO at step S20), the program flow is returned to the main routine.

When the APS flag is 0 (YES at step S20) and the paper feed tray selection key 731 is not turned ON (NO at step S21), it is detected at step S33 whether the LCT 1030 is selected. Then, at step S34, it is detected whether an empty signal transmitted from the CPU 502 to the CPU 501 is 1. If the LCT 1030 is not selected (NO at step S33), the program flow is returned to the main routine. When the LCT 1030 is selected (YES at step S33) and the empty signal is 1 (YES at step S34), the empty flag for LCT 1030 is set to 1 at step S35 and the program flow is proceeded to step S38. When the LCT 1030 is selected (YES at step S33) and the empty signal is 0 (NO at step S34), the program flow is moved to step S38 after the empty flag for the LCT 1030 is reset to 0 (step S36).

In the meantime, if the APS flag is 0 (YES at step S20) and the paper feed tray selection key 731 is turned ON (YES at step S21), it is judged at step S22 whether the upper paper feed tray 42 is selected. Then, at step S23, whether the lower paper feed tray 43 is selected is detected.

When the upper paper feed tray 42 is selected (YES at step S22), the lower paper feed tray 43 is selected at step S23 and the display LED 800 is turned OFF at step S24, with the display LED 801 for the lower paper feed tray 43 being turned OFF at step S25. Thereafter, the program flow is passed to step S37.

Referring to FIG. 9*b*, if the lower paper feed tray 43 is selected (YES at step S26), the LCT 1030 is selected at step S27. The display LED 801 for the lower paper feed tray is turned OFF at step S28 and the display LED 802 for the LCT 1030 is turned ON at step S29. The program flow proceeds to step S38.

If neither the upper paper feed tray 42 nor the lower paper feed tray 43 is selected (NO at steps S22 and S26), the upper paper feed tray 42 is selected at step S30, the display LED 802 for the LCT is turned OFF at step S31 and the display LED 800 for the upper paper feed tray 42 is turned ON at step S32. Then, the program flow is advanced to step S37.

At step S37, after a process for setting the paper size is carried out, the selected paper size is indicated in the paper size display part 805 at step S38. The program flow goes back to the main routine.

Figure 10A:
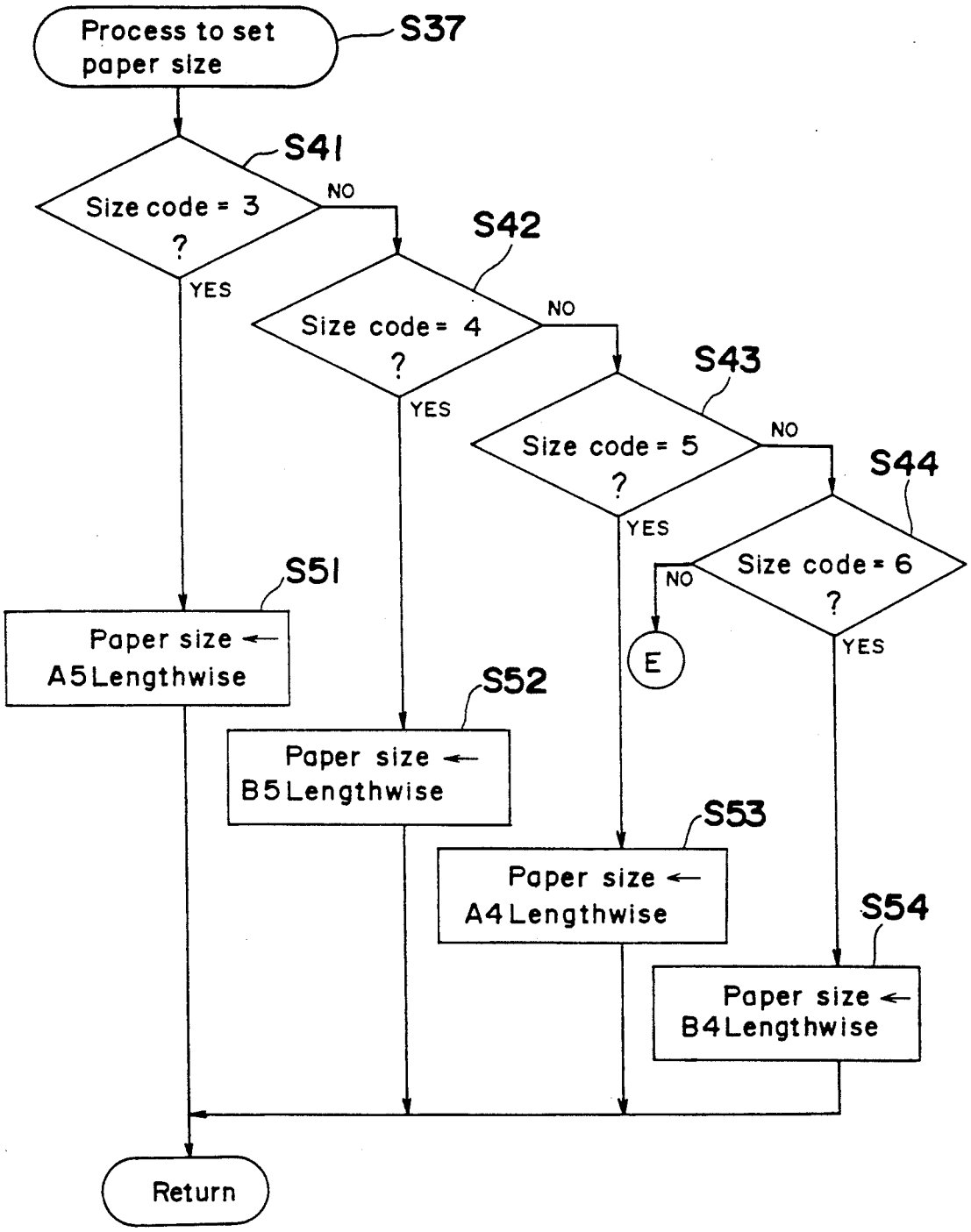
FIGS. 10*a* and 10*b* are flow charts of a paper size setting process of FIGS. 9 and 12*a*.
Figure 10B:
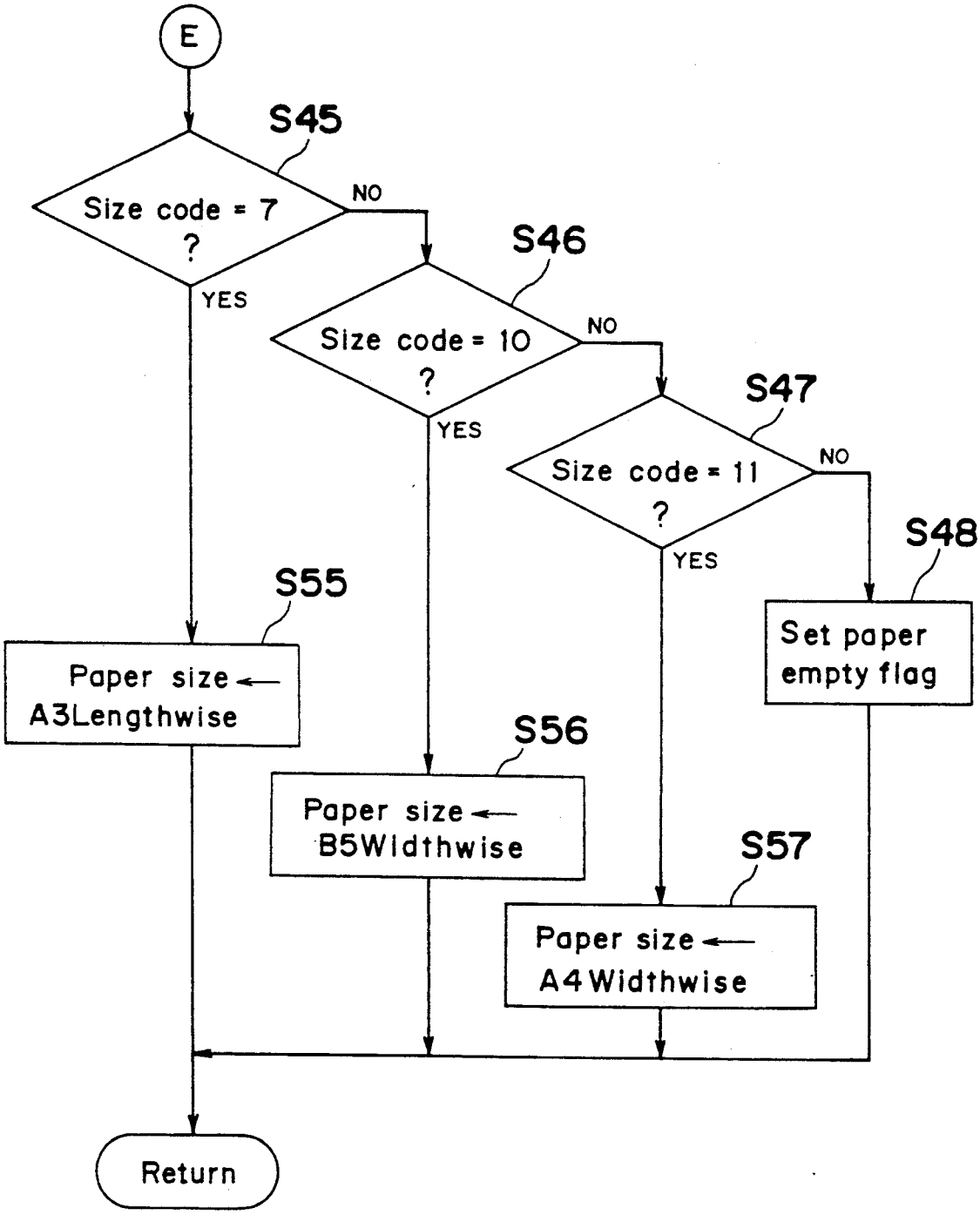
Figure 12A:
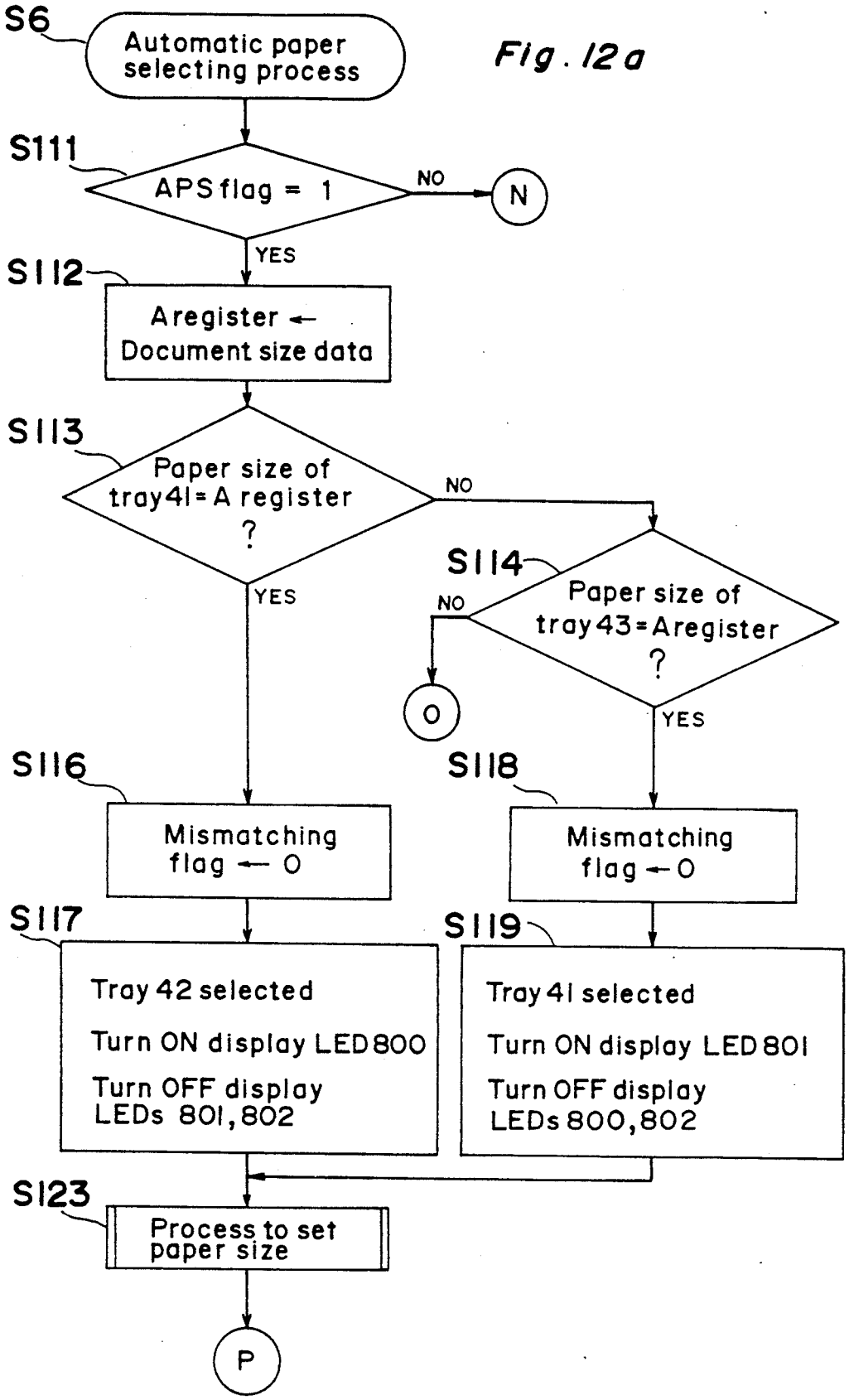
FIGS. 12*a* and 12*b* are flow charts of an automatic paper selecting process of FIG. 7.

FIGS. 10*a* and 10*b* are flow charts of the process to set the paper size in FIGS. 9 and 12*a* (steps S37 and S123).

At steps S41–S47 of FIGS. 10*a* and 10*b*, it is checked whether the size code set on the basis of both the detecting signals of switches SW1–SW4 inputted to the CPU 501 and the paper size to be set for the LCT 1030 is 3, 4, 5, 6, 7, 10, or 11. According to the present embodiment, the size code is set to be 5 beforehand when the LCT 103 is selected.

When the size code is 3 (YES at step S41), the paper size is set to "A5 lengthwise" at step S51, and the program flow is returned to the original routine. Moreover, when the size code is 4. (YES at step S42), the paper size is set to "B5 lengthwise" at step S52. Then, the program flow is returned to the original routine. If the size code is detected to be 5 (YES at step S43), "A4 lengthwise" is set as the paper size at step S53, with the program flow being returned to the original routine. Further, if the size code is 6 (YES at step S44), "B4 lengthwise" is set as the paper size at step S54, and the program flow is returned to the original routine. If the size code is 7 (YES at step S45), after "A3 lengthwise" is set at step S55, the program flow is goes back to the original routine. When the size code is 10 (YES at step S46), "B5 widthwise" is set as the paper size at step S56, with returning the program flow to the original routine. If the size code is 11 (YES at step S47), "A4 widthwise" is set for the paper size at step S57 and the program flow is returned to the original routine. On the other hand, if any size code is not detected (NO in all the steps S41–S47), the paper empty flag for the paper feed tray selected at step S48 is set to be 1, and then the program flow is returned to the original routine.

It is to be noted here that the paper empty flag is provided for each of the paper feed trays 42, 42 and 1030. Therefore, the paper empty flag which is an object to be processed in a routine to come hereinbelow is one for the paper feed tray 42, 43 or 1030 selected at that time.

FIGS. 11*a* to 11*g* are flow charts of the copying process of FIG. 7 (step S5).

Figure 11A:
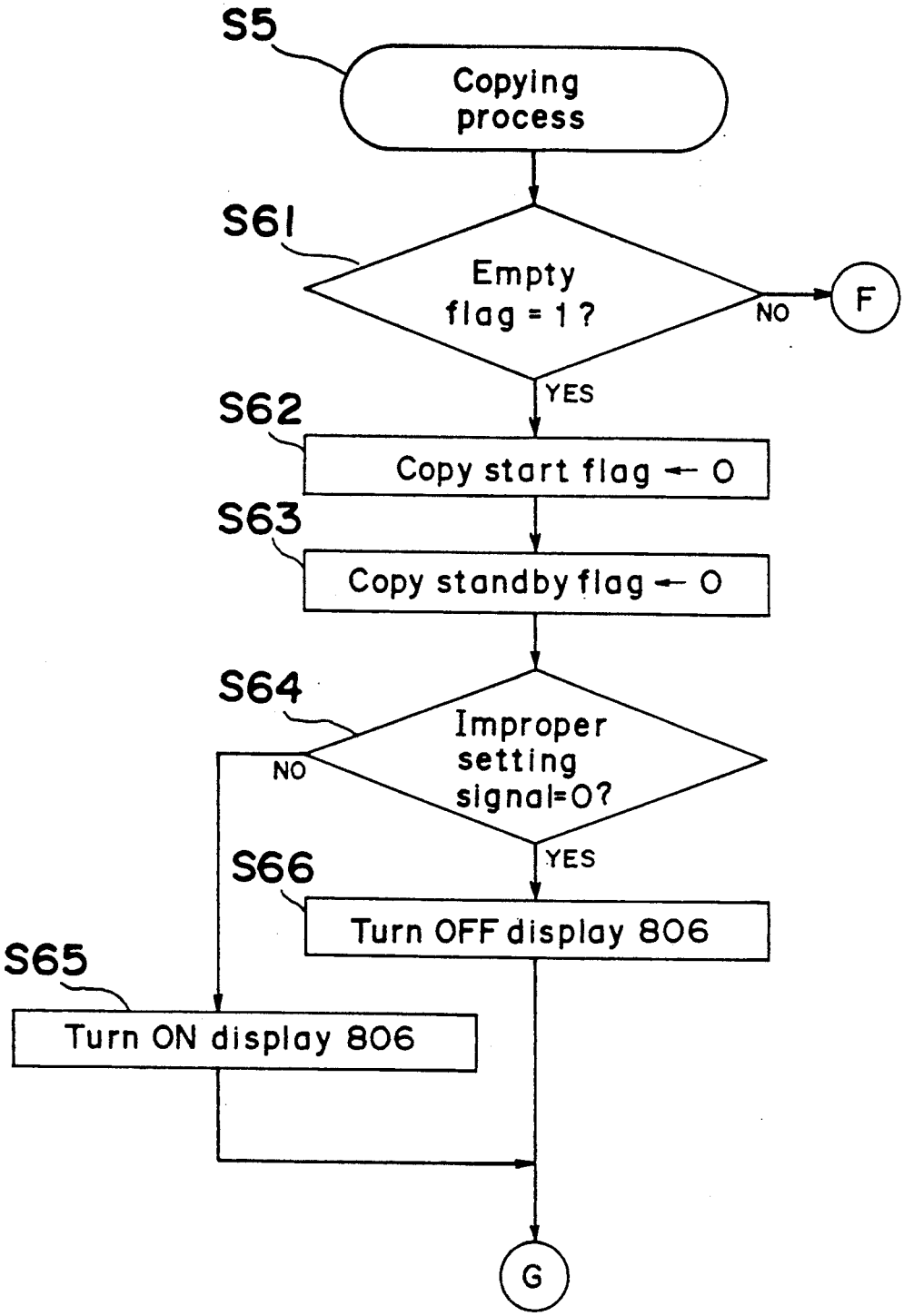
FIGS. 11*a* to 11*g* are flow charts of a copying process of FIG. 7.

Referring first to FIG. 11*a*, it is checked at step S61 whether the empty flag for the selected paper feed tray is 1, and when the empty flag is 1 (YES at step S61), the copy start flag is reset to be 0 at step S62 and the copy standby flag is reset to 0 at step S63. Subsequently, it is detected at step S64 whether an improper setting signal transmitted from CPU 502 to CPU 501 is 0. If the improper setting signal is 0 (YES at step S64), the setting improper display part 806 is turned OFF with the program flow proceeding to step S80. On the other hand, if the improper signal is 1 (NO at step S64), the setting improper display part 806 is turned ON, and then, the program flow is proceeded to step S80.

Figure 11B:
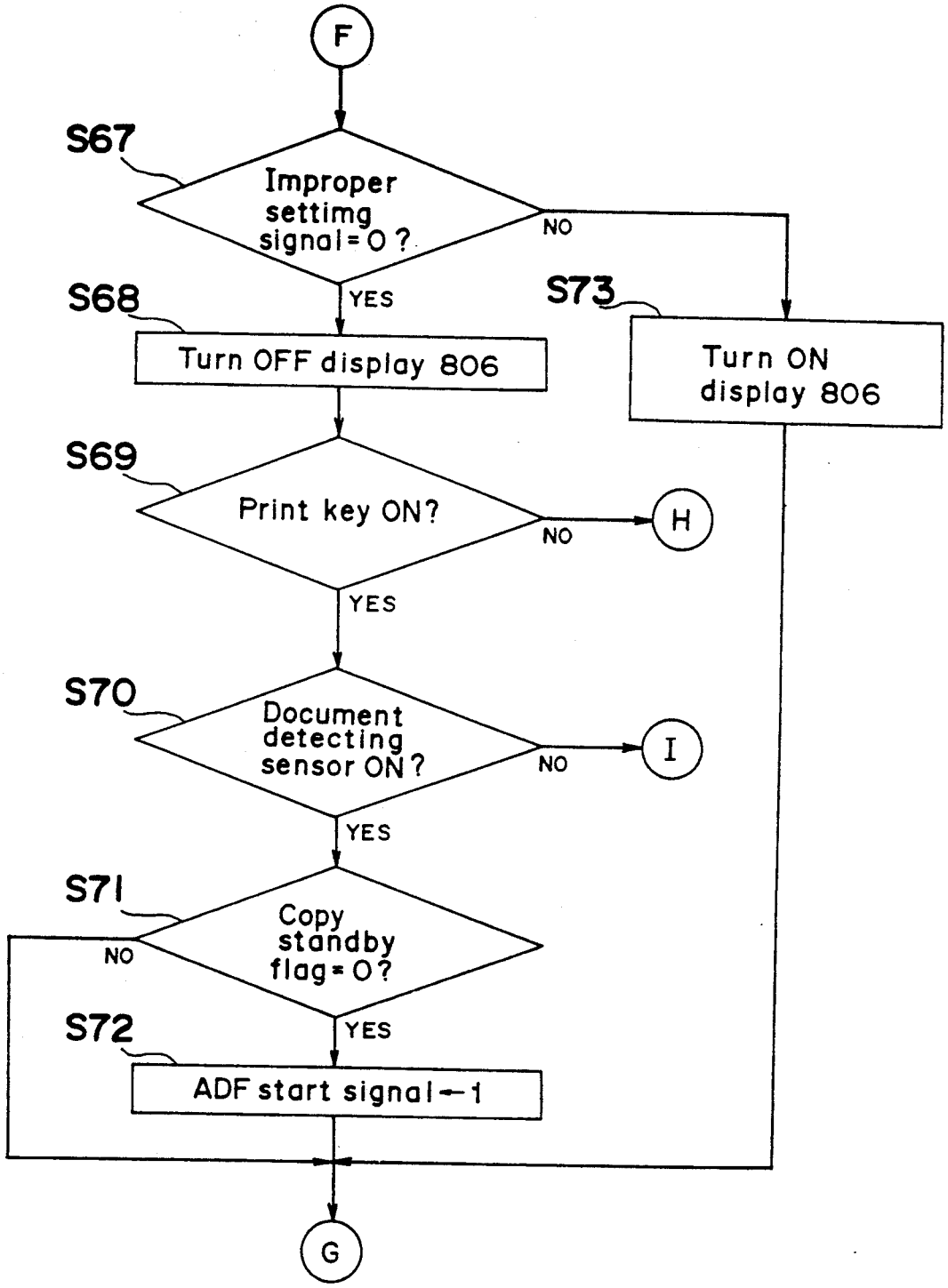

In the case where the empty flag for the selected paper feed tray is not 1 at step S61 (NO at step S61), it is checked at step S67 of FIG. 11*b* whether the improper setting signal for the LCT 1030 is 0. If the improper setting signal is 1 (NO at step S67), after the setting improper display part 806 is turned ON at step S73, the program flow is moved to step S80. On the contrary, if the improper setting signal is 0 (YES at step S67), after the improper display part 806 is turned OFF at step S68, it is detected at step S69 whether the print key 721 is turned ON.

When the print key 721 is turned ON (YES at step S69), the ON/OFF state of the document detecting sensor 311 is detected at step S70. At step S71, it is detected whether the copy standby flag is 0. If the document detecting sensor 311 is OFF (NO at step S70), the program flow proceeds to step S76, where it is detected whether the LCT 1030 is selected. When the LCT 1030 is not selected (NO at step S76), the copy start flag is set to 1 at step S78 and at the same time, the copy standby flag is reset to 0. Then, the program flow is proceeded to step S80. On the other hand, if the LCT 1030 is selected (YES at step S76), it is detected at step S77 whether the elevator up signal transmitted from the CPU 502 to the CPU 501 is 0. If the elevator up signal is 0 (YES at step S77), the program flow moves to step S78, whereas, if the elevator up signal is 1 (NO at step S77), the copy standby flag is set to 1 at step S79 and the program flow proceeds to step S80.

In the above step S70, if the document detecting sensor 311 is in the ON state (YES at step S70) and the copy standby flag is not 0 (NO at step S71), the program flow is advanced to step S80. However, if the document detecting sensor 311 is ON at step S70 (YES at step S70) and the copy standby flag is 0 (YES at step S71), the ADF start signal transmitted from the CPU 501 to the CPU 503 is set to 1 at step S72. Then, the program flow is moved to step S80.

Figure 11C:
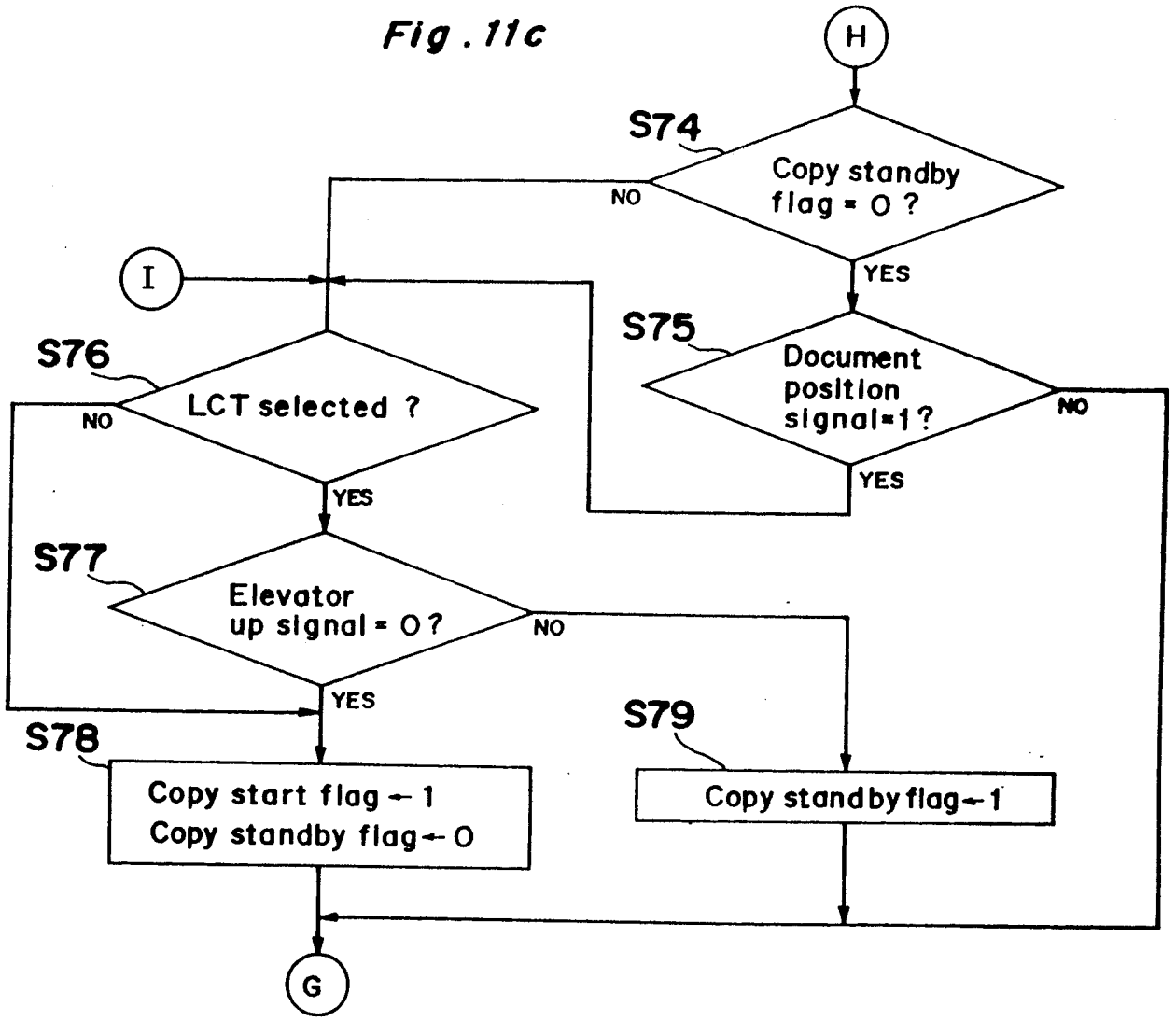

At step S69 described above, if the print key 721 is not turned ON (NO at step S69), it is checked at step S74 of FIG. 11*c* whether the copy standby flag is 0. If the copy standby flag is 1 (NO at step S74), the program flow goes to step S76. On the other hand, if the copy standby flag is 0 (YES at step S74), it is discriminated at step S75 whether a document position signal indicating whether a document is placed at a predetermined position on the document glass 11 is 1. When the document position signal is 1 (YES at step S75), it proceeds to step S76. When the document position signal is 0 (NO at step S75), the program flow goes to step S80.

Figure 11D:
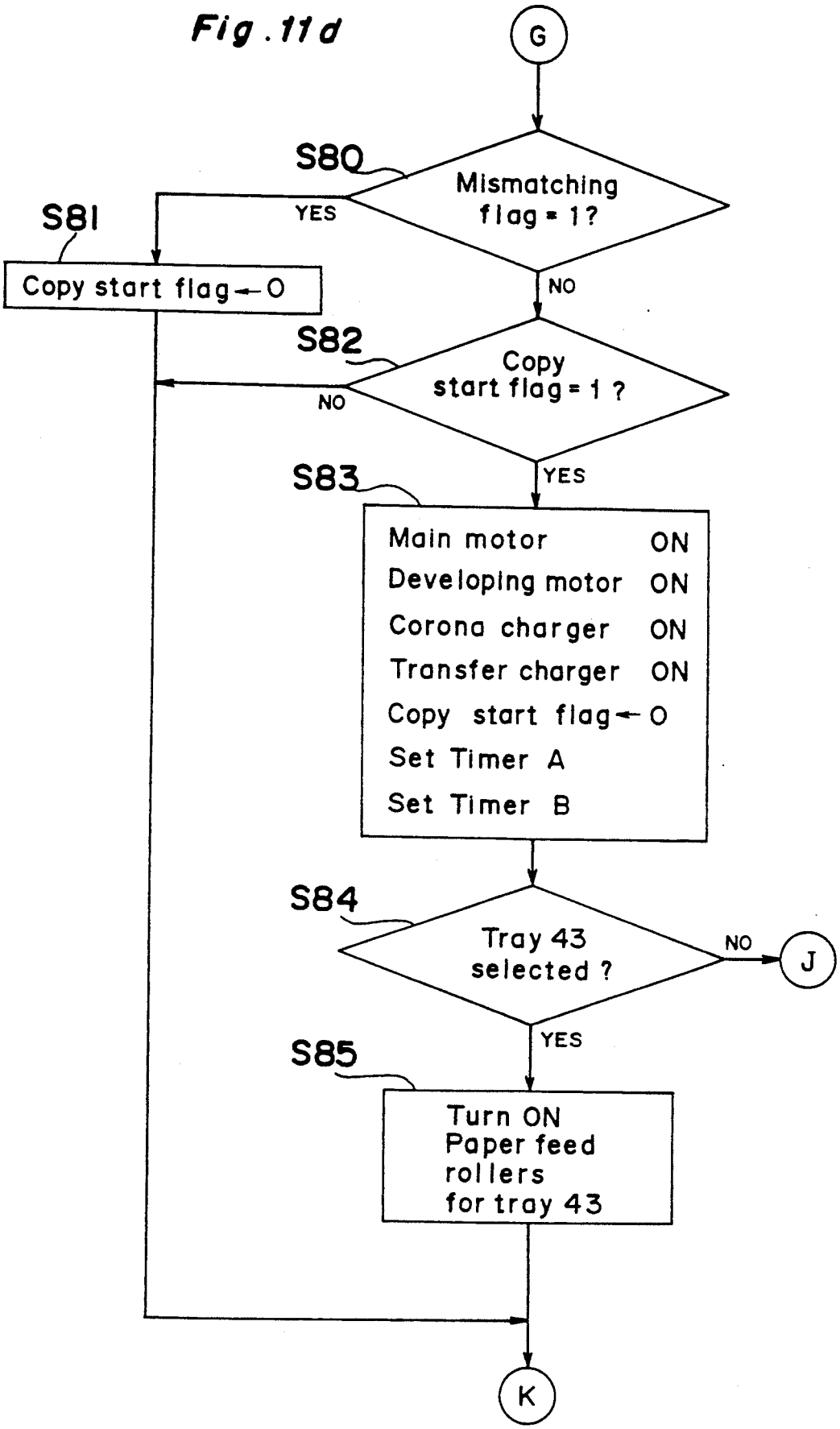

At step S80 of FIG. 11*d*, whether a mismatching flag which is set in an automatic paper selecting process described later with reference to FIG. 12*a* is detected. In the case of the mismatching flag indicating 1 (YES at step S80), the program flow goes to step S89 after the copy start flag is reset to 0 at step S81. In contrast, when the mismatching flag is 0 (NO at step S80), it is detected at step S82 whether the copy start flag is 1. When the copy start flag is 0 (NO at step S82), the program flow goes to step S89. On the other hand, when the copy start flag is 1 (YES at step S82), the program flow runs to step S83, where a main motor of the main body 1, a developing motor for the developing device 3, the corona charger 6 and the transfer charger 5*a* are all turned ON, with the copy start flag being reset to 0 and timers A and B provided within the CPU 501 being set to start counting.

Thereafter, the paper feed rollers of the selected paper feed tray are driven. In other words, when the lower paper feed tray 43 is selected (YES at step S84), the paper feed rollers 19 for the tray 43 are turned ON at step S85 and then, the program flow goes to step S89 of FIG. 11*e*. If the upper paper feed tray 42 is selected (YES at step S86), the paper feed rollers 18 of the tray 42 are started at step S87 and the program flow goes to step S89. If the LCT 1030 is selected (NO in both steps S84 and S86), an LCT paper feed signal transmitted from CPU 501 to CPU 502 is set to 1, and the program flow moves to step S89.

Figure 11E:
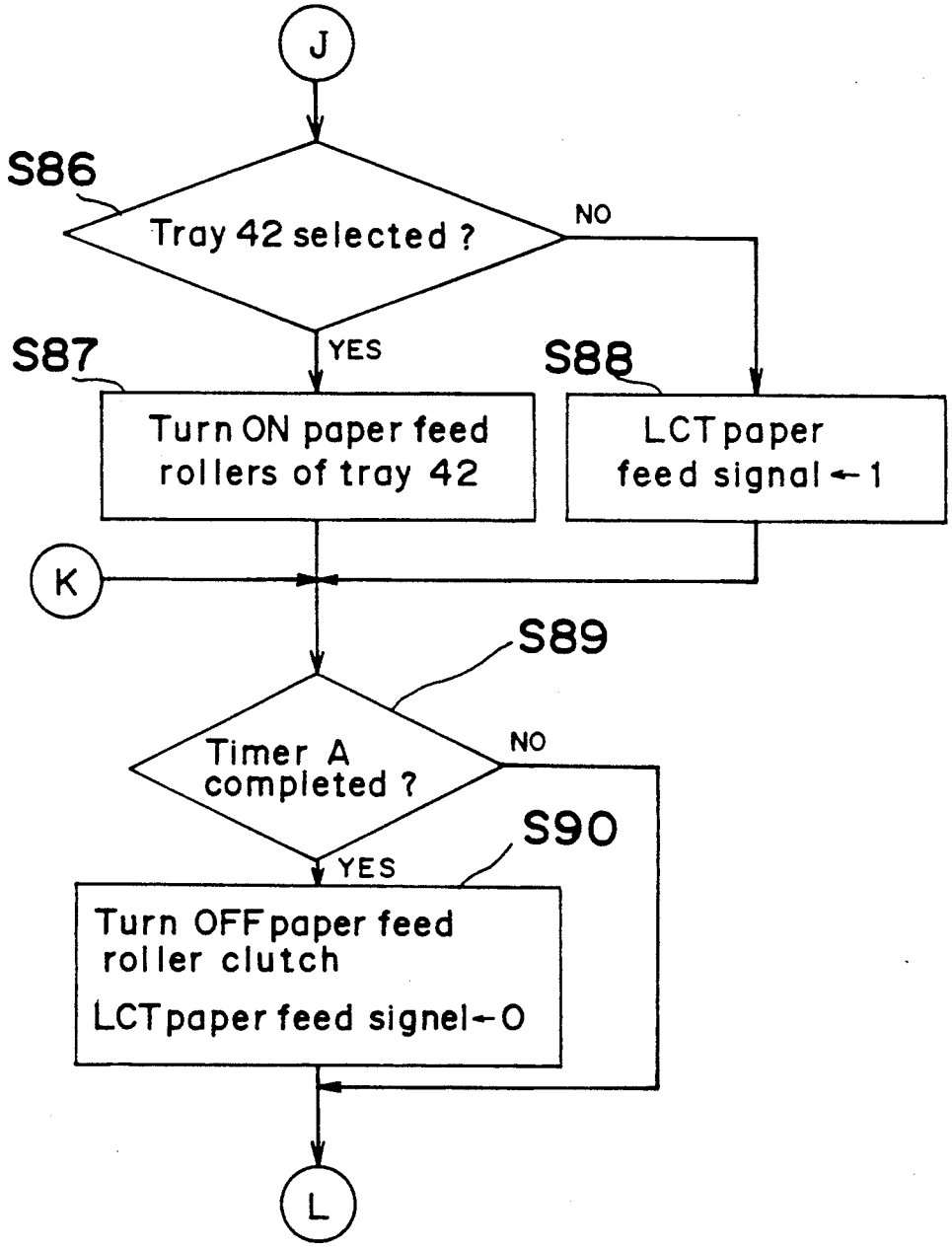
Figure 11F:
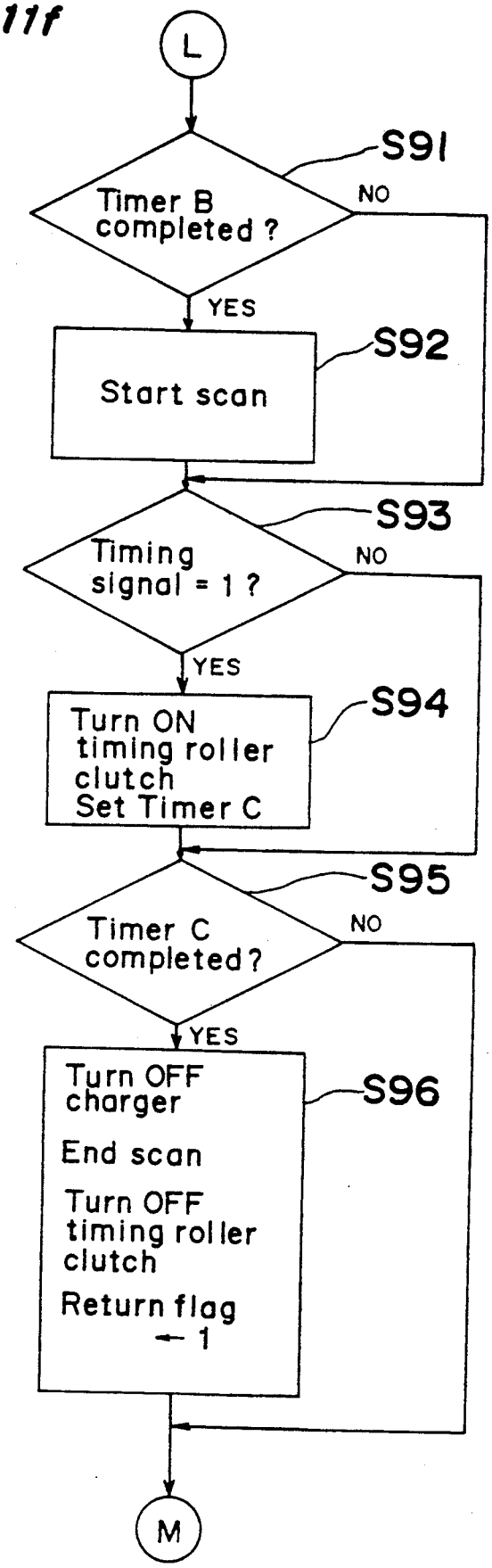

Referring to FIG. 11*e*, it is detected at step S89 whether counting of the timer A is finished. When counting of the timer A is completed (YES at step S89), a paper feed roller clutch which is currently driven is stopped at step S90, thereby resetting the LCT paper feed signal to 0. Then, the succeeding step S91 follows. If counting of the timer A is not finished (NO at step S89), the program flow is directly led to step S91 of FIG. 11*f*.

When it is detected at step S91 that counting of the timer B is finished (YES), scanning for the copying operation is started at step S92, and then, the program flow goes to step S93. Otherwise, the program flow moves directly to step S93 if counting of the timer B is not finished (NO at step S91).

At step S93, it is detected whether a timing signal is 1. When the timing signal is 1 (YES at step S93), a timing roller clutch (not shown) is turned ON and the timer C is set to start counting at step S94. If the timing signal is 0 (NO at step S93), the program flow skips to flow S95.

It is detected at step S95 whether the timer C is finished counting. When the timer C is finished counting (YES at step S95), the corona charger 6 is turned OFF at step S96 to end scanning, turn OFF the timing roller clutch and set a return flag for the optical system to 1. Thereafter, the program flow moves to step S97 of FIG. 11*g*. If the timer C is not finished (NO at step S95), the program flow goes to step S97 directly from step S95.

Figure 11G:
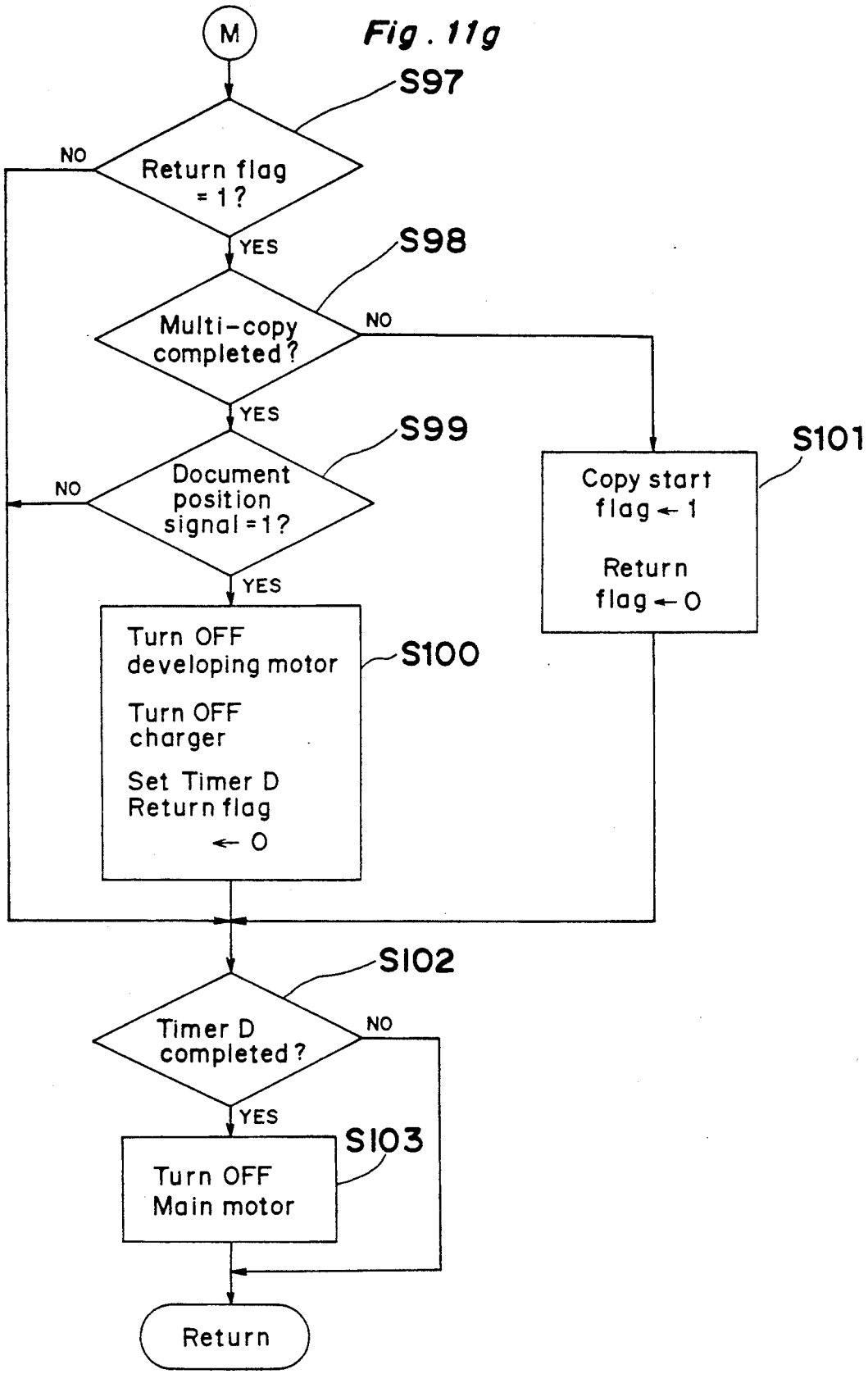

In the subsequent step S97 of FIG. 11*g*, it is checked if a return flag for the optical system is 1. When the return flag is 0 (NO at step S97), the program flow directly goes to step S102, whereas when the return flag is 1 (YES at step S97), it is judged at step S98 whether the copying operation for the set number of copies is completely finished. Unless it is completed, the copy start flag and return flag are set to 1 and 0, respectively, at step S101, which is followed by step S102. On the other hand, if the copying operation for the set number of copies is finished (YES at step S98), it is detected at step S99 whether the document position signal is 1. When the document position signal is 0 (NO at step S99), the program flow goes to step S102. If the document position signal is 1 (YES at step S99), the developing motor of the developing device 3 is turned OFF at step S100, with the transfer charger 5*a* being turned OFF and a timer D provided within CPU 501 being started. In addition, the return flag is reset to 0. Then, the program flow proceeds to step S102.

It is detected at step S102 whether the timer D is finished counting. When the timer D is finished counting (YES at step S102), the main motor of the main body 1 is turned OFF at step S103. Thereafter, the program flow is returned to the main routine. On the other hand, if the timer D is not finished counting (NO at step S102), the program flow moves directly to the main routine from step S102.

Figure 12B:
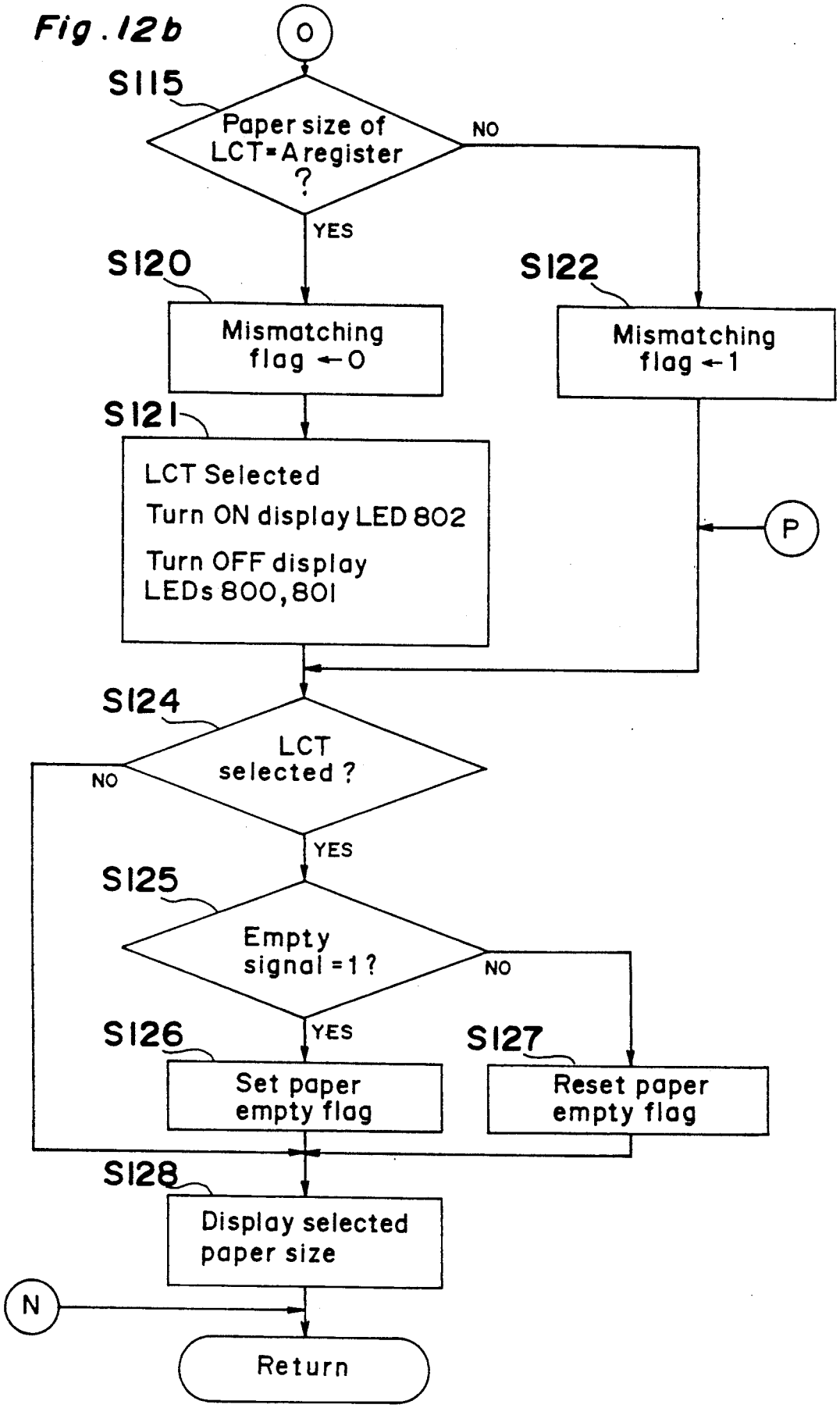

FIGS. 12*a* and 12*b* depict the automatic paper selecting process (step S6) in FIG. 7.

Referring first to FIG. 12*a*, it is detected at step S111 whether an APS flag is 1. When the APS flag is 0 (NO at step S111), the program flow returns to the main routine. Otherwise, if the APS flag is 1 (YES at step S111), after the document size data transmitted from the CPU 503 to the CPU 501 is set in an A register provided within CPU 501, it is checked at steps S113, S114 and S115 whether the data stored in the A register agrees with the size of copying papers set in the upper paper feed tray 41, the lower paper feed tray 43 and the LCT 1030, respectively.

In the case where the size data stored in the A register is coincident with the paper size of the upper paper feed tray 42 (YES at step S113), the mismatching flag is reset to 0 at step S116 and the upper paper feed tray 42 is selected at step S117, and then, the upper paper feed tray selection display LED 800 is turned ON. Moreover, the lower paper feed tray selection display LED 801 and the LCT selection display LED 802 are both turned OFF. Then, the program flow goes to step S123.

Meanwhile, if the size data stored in the A register agrees with the paper size of papers set in the lower paper feed tray 43 (YES at step S114), the mismatching flag is reset to 0 at step S118. Thereafter, the lower paper feed tray 43 is selected at step S119, and at the same time, the lower paper feed tray selection display LED 801 is turned ON, and the upper paper feed tray selection display LE 800 and the LCT selection display LED 802 are turned OFF. Then, it is followed by step S123.

Likewise, if the data stored in the A register agrees with the paper size set in the LCT 1030 (fixed at "A4" as described earlier) (YES at step S115), the mismatching flag is reset to 0 at step S120. The LCT 1030 is selected at step S121, thereby turning ON the LCT selection display LED 802 while turning OFF the upper and lower paper feed tray selection display LEDs 800 and 801. Then, the program flow advances to step S124.

If the size data stored in the A register does not agree with any paper size set on the upper and lower paper feed trays 42 and 43 and the LCT 1030 (NO at steps S113–S115), the mismatching flag is set at step S122. The program flow moves to step S124.

At step S124 of FIG. 12*b*, it is detected whether LCT 1030 is selected. Without the LCT 1030 selected (NO at step S124), the program flow goes to step S128. If the LCT 1030 is selected (YES at step S124), it is detected at step S125 whether an empty signal transmitted from the CPU 502 to the CPU 501 is 1. When the empty signal is 1 (YES at step S125), a paper empty flag for the LCT 1030 is set to 1 at step S126, and the program flow moves to step S128. On the contrary, if the empty signal is 0 (NO at step S125), the paper empty signal for the LCT 1030 is reset to 0 at step S127, with the flow proceeding to step S128.

After the selected paper size is displayed on the paper size display part 805 at step S128, the program flow goes back to the main routine.

(e) Operation of LCT Driving Device

Figure 13:
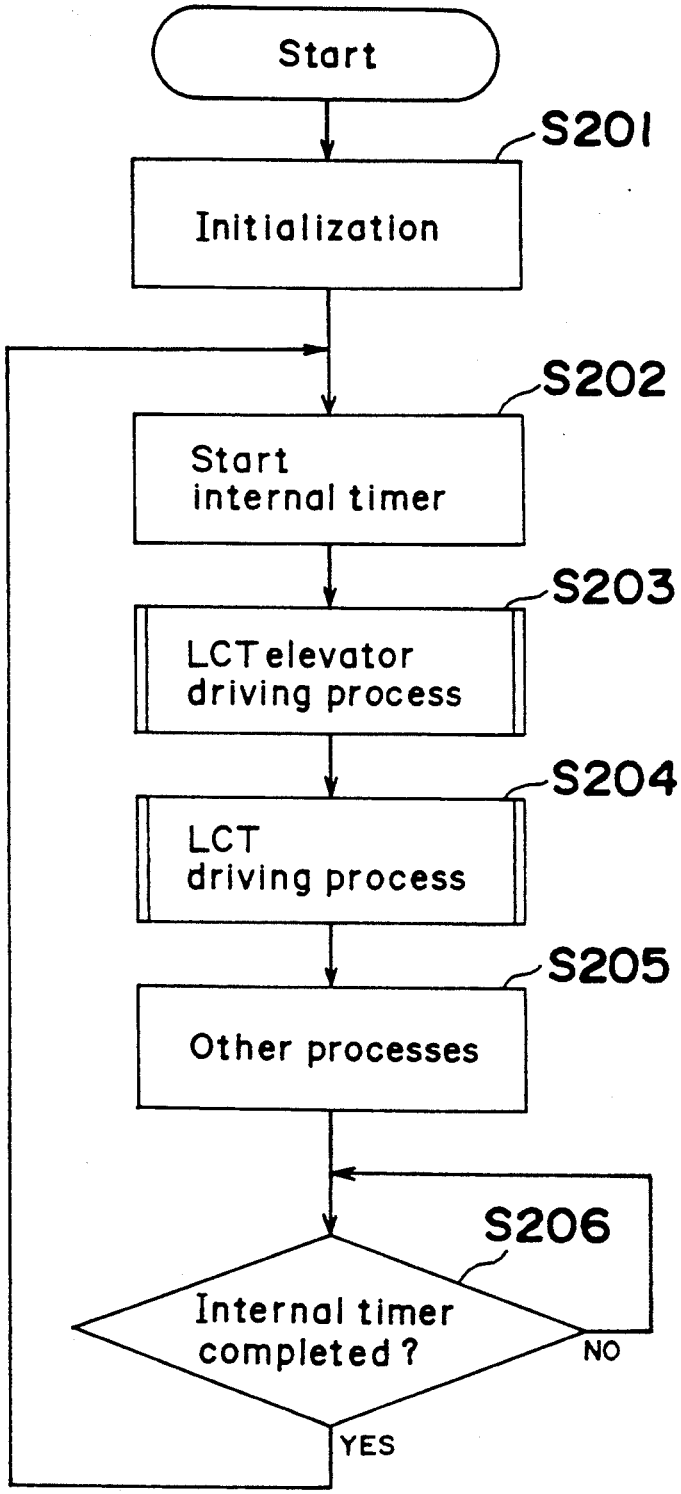
FIG. 13 is a flow chart of a main routine of the LCT controlling part of the LCT driving device of FIG. 5.

FIG. 13 is a flow chart of a main routine performed by the CPU 502 of the controlling part of LCT driving device 1000 in FIG. 5.

As indicated in FIG. 13, when the program of the subject main routine is started as the CPU 502 is reset, data stored in the RAM (not shown) connected to CPU 502 is cleared at step S201, so that various registers provided within CPU 502 are initialized, that is, the CPU 502 is initialized and also the LCT driving device 1000 is set in the initial mode. Thereafter, counting of the internal timer provided within CPU 502 which has a predetermined value set beforehand in the initialization step described above is started at step S202.

After an LCT elevator driving process is carried out at step S203 and an LCT driving process is executed at step S204, a communications process with CPU 501 and the like are conducted at step S205 until counting of the internal timer is finished at step S206. Upon completion of counting of the internal timer (YES at step S206), the program flow returns to step S202, whereby the above procedure is repeated.

Figure 14A:
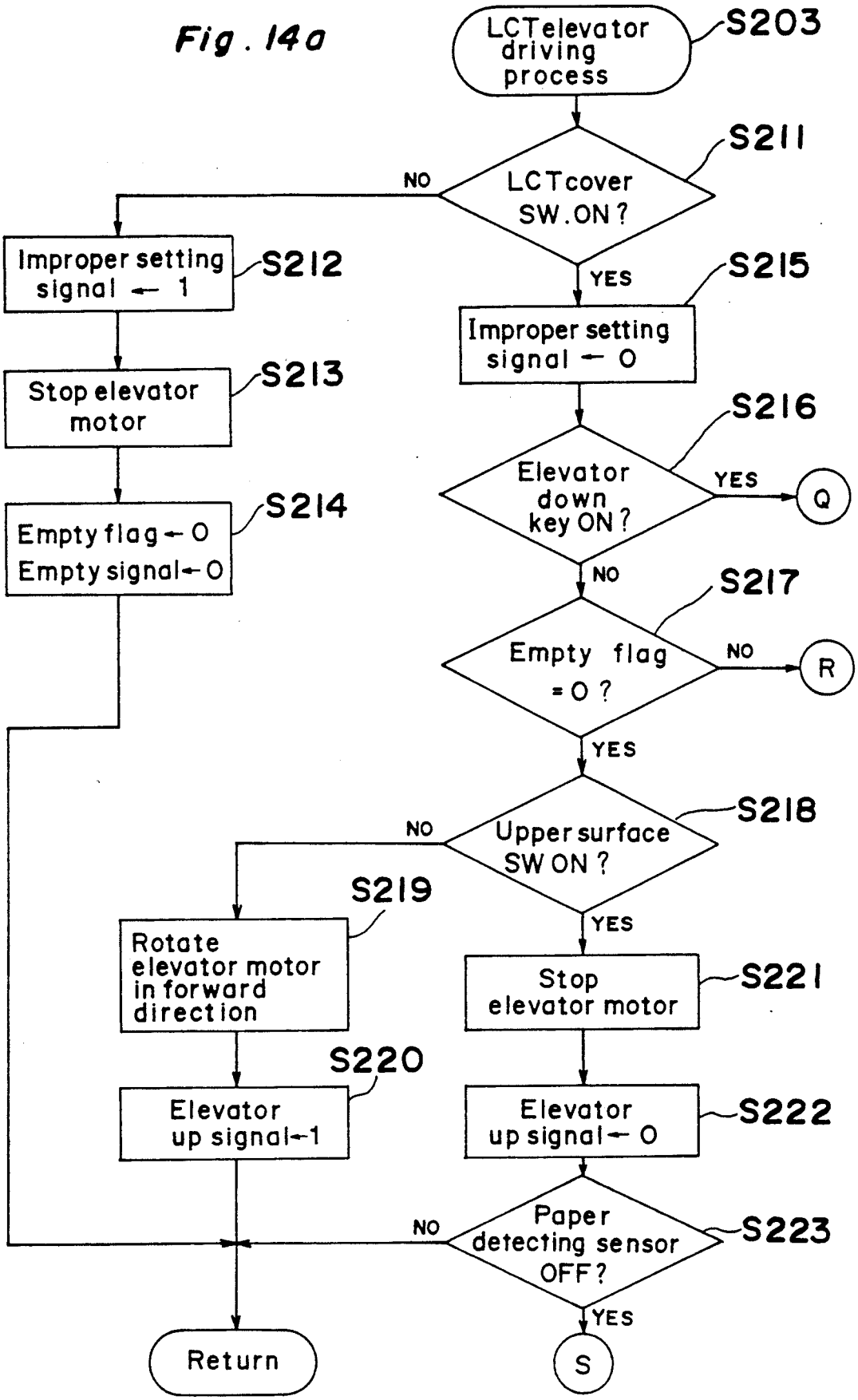
FIGS. 14*a* and 14*b* are flow charts of an LCT elevator driving process of FIG. 13.
Figure 14B:
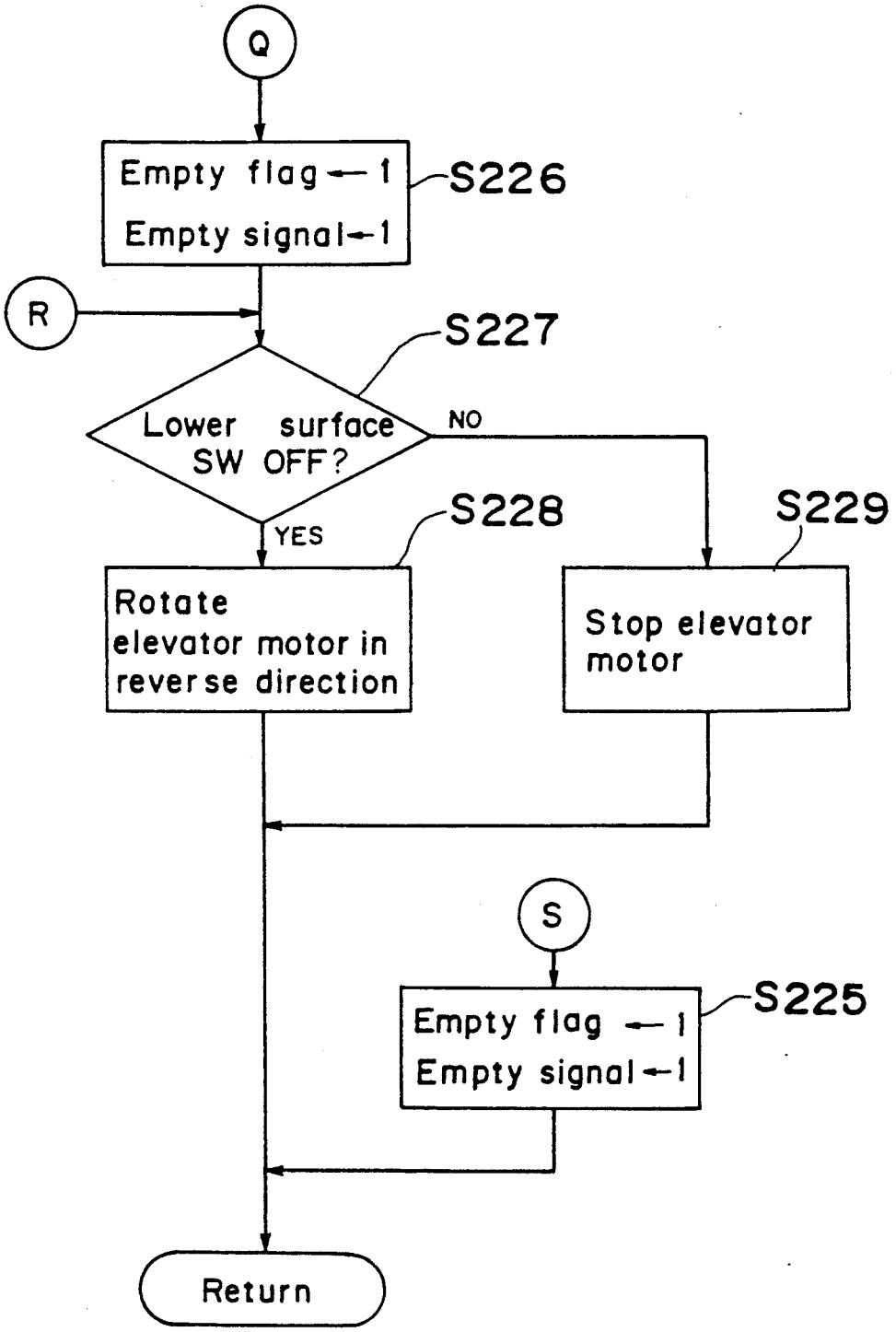

FIGS. 14*a* and 14*b* are flow charts of the LCT elevator driving process (step S203) in FIG. 13.

Referring to FIG. 14*a*, it is detected first at step S211 whether the LCT cover switch 1003 is turned ON. When the cover switch 1003 is in the OFF state, namely, when the LCT cover is opened (NO at step S211), the improper setting signal transmitted from the CPU 502 to the CPU 501 is set to 1 at step S212. Accordingly, the elevator motor 1010 for moving the elevator 1020 is stopped at step S213. Moreover, the empty flag for the LCT 1030 is reset to 0 at step S214 and the empty signal transmitted from the CPU 502 to the CPU 501 is reset to 0. Then, the program flow returns to the main routine.

Meanwhile, if the LCT cover switch 1003 is in the ON state, i.e., the LCT cover is closed at step S211 (YES at step S211), the improper setting signal is reset to 0 at step S215 to notify the CPU 501 that the LCT cover is closed. Then, it is detected at step S216 whether or not the elevator down key 901 forcing the elevator 1020 to descend is turned ON. It is further detected at step S217 whether the empty flag is 0. If the elevator down key 901 is turned ON (YES at step S216), the empty flag is set to 1 at step S226 of FIG. 14*b*, with the empty signal set to 1. Thereafter, the program flow starts to step S227. On the other hand, if the elevator down key 901 is not turned ON (NO at step S216) and the empty flag is not 0 (NO at step S217), the program flow proceeds to step S227 to detect whether the elevator lower switch 1004 indicating whether the elevator 1020 is at the lowest position is in the OFF state. If the elevator lower switch 1004 is in the OFF state and the elevator 1020 is not at the lowest position (YES at step S227), the elevator motor 1010 is rotated in the reverse direction at step S228 thereby descending the elevator 1020, and then, the program flow returns to the main routine. However, if the elevator lower switch 1004 is in the ON state and the elevator 1020 is at the lowest position (NO at step S227), the elevator motor 1010 is stopped at step S229 and the program flow returns to the main routine.

When the empty flag is 0 at step S217 (YES at step S217), it is discriminated at step S218 whether the upper surface switch 1002 is ON, that is, whether the copying paper is at a position ready to be supplied. If the upper surface switch 1002 is in the OFF state (NO at step S218), the elevator motor is rotated in the forward direction at step S219 so as to move up the elevator 1020. The elevator up signal is set to 1 at step S220, thereby notifying CPU 501 that the elevator 1020 is now moving upward. Then, the program flow is returned to the main routine. On the other hand, when the upper surface switch 1002 is in the ON state (YES at step S218), this means that the elevator 1020 or the uppermost copying paper is at the highest position, and therefore, the elevator motor 1010 is stopped at step S221, and the elevator up signal is reset to 0 at step S222 to inform the CPU 501 that the elevator 1020 is stopped. The program flow then proceeds to step S223.

At step S223, it is detected whether or not the paper detecting sensor 1003 is turned OFF. If the paper detecting sensor 1003 is in the OFF state without copying papers set (YES at step S223), the empty flag is set to 1 at step S225 and also the empty signal is set to 1 to inform CPU 501 that the copying papers are not set. The program flow returns to the main routine thereafter. On the contrary, if the paper detecting sensor 1003 is in the ON state (NO at step S223), the copying papers are set and the program flow returns to the main routine directly from step S223.

Figure 15:
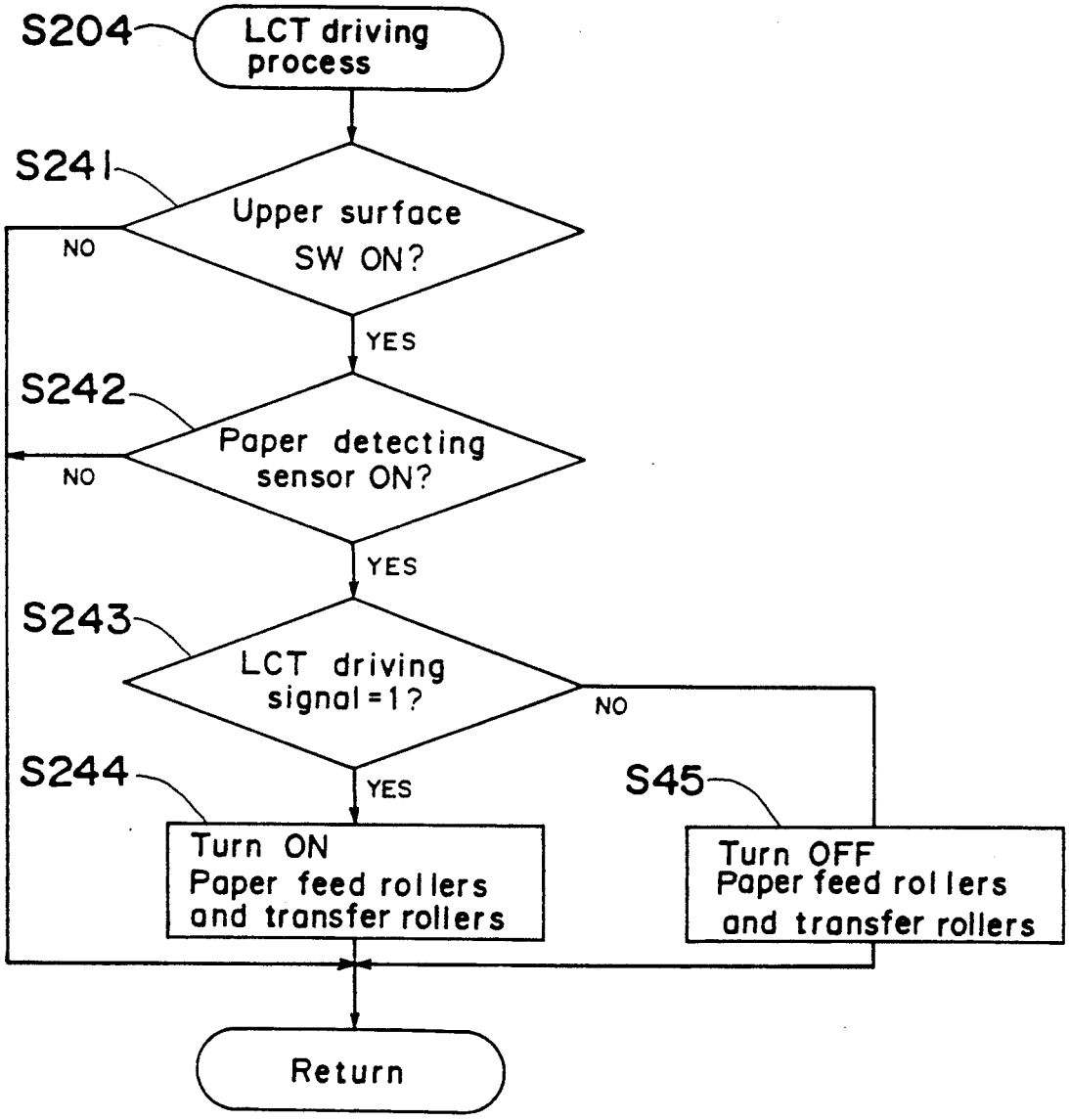
FIG. 15 is a flow chart of a paper feeding process of FIG. 13.

FIG. 15 is a flow chart of the LCT driving process (step S204) in FIG. 13.

At step S241 of FIG. 15, it is detected whether the upper surface switch 1002 is ON. In the next step S242, it is detected whether the paper detecting sensor 1001 is turned ON. If either the upper surface switch 1002 or the paper detecting switch 1001 is turned OFF (NO at step S241 or step S242), the program flow returns to the main routine.

In the case where not only the upper surface switch 1002 but also the paper detecting sensor 1001 is turned ON (YES at steps S241 and S242), it is detected at step S243 whether an LCT driving signal transmitted from the CPU 501 to the CPU 502 is 1. If the LCT driving signal is 1 (YES at step S243), the paper feed roller 1011 and the transfer rollers 1012 and 1013 are turned ON at step S244, so that the copying papers set in LCT 1030 are fed to the main body 1. Thereafter, the program flow goes to the main routine. On the other hand, if the LCT driving signal is 0 (NO at step S243), the paper feed roller 1011 and the transfer rollers 1012 and 1013 are turned OFF at step S245, thereby stopping the supply of copying papers. Then, the program flow returns to the main routine.

(f) Operation of ADF Device

Figure 16:
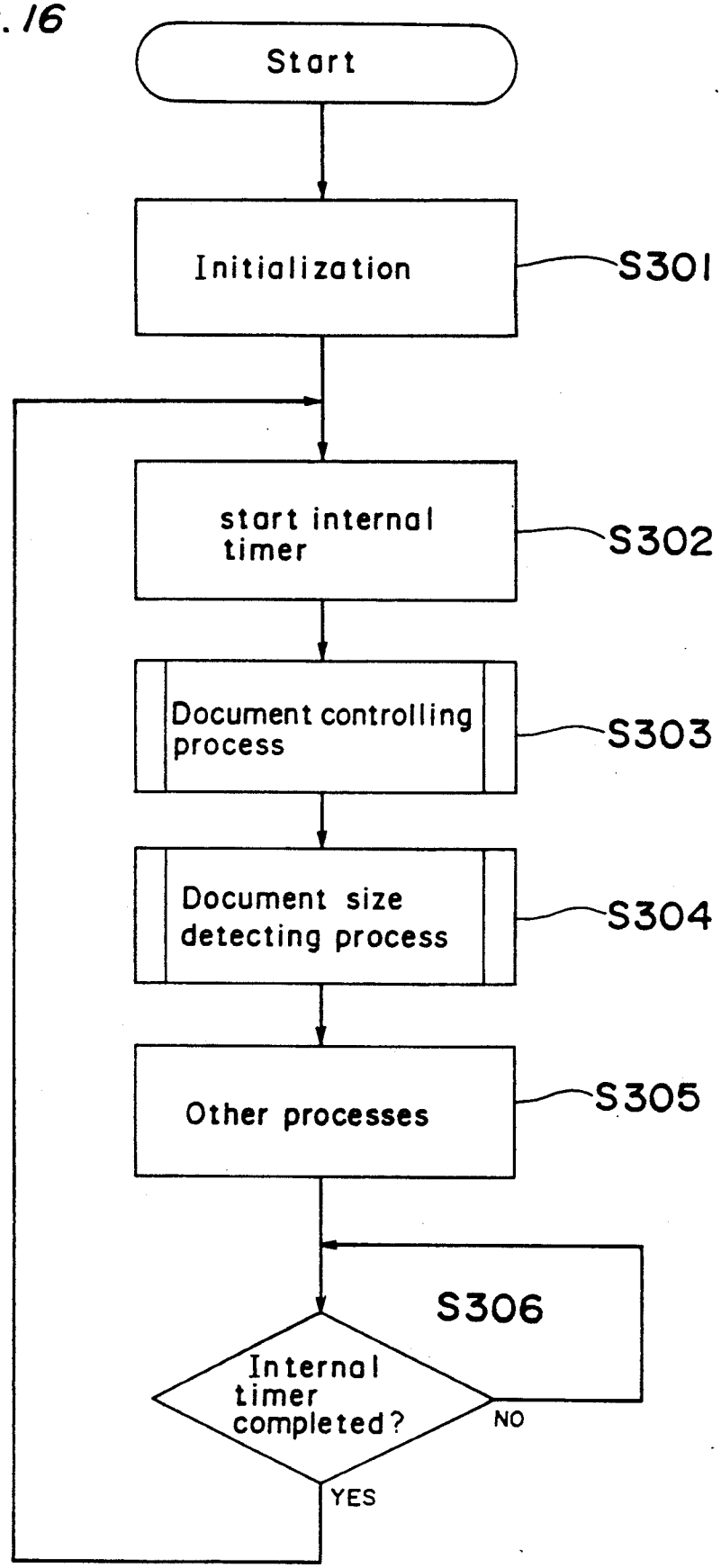
FIG. 16 is a flow chart of a main routine of the ADF controlling part of the ADF device of FIG. 6.

FIG. 16 is a flow chart of a main routine carried out by the CPU 503 of the controlling part of the ADF device in FIG. 6.

As shown in FIG. 16, when the CPU 503 is reset to start the program of the subject main routine, the data of the RAM (not shown) connected to CPU 503 is cleared at step S301. As a result, the CPU 503 is initialized. After the ADF device 300 is set in the initial mode, an internal timer incorporated in the CPU 503 wherein a predetermined time is set beforehand in the initialization process described above is started at step S302.

A document controlling process and a document size detecting process are carried out in respective steps S303 and S304. The other processes such as a communications process with the CPU 501 are executed at step S305. In this state, the program flow is kept standing by until counting of the internal timer is complete. When counting of the internal timer is completed (YES at step S306), the program flow returns to step S302, and then, the above procedure is repeated.

Figure 17A:
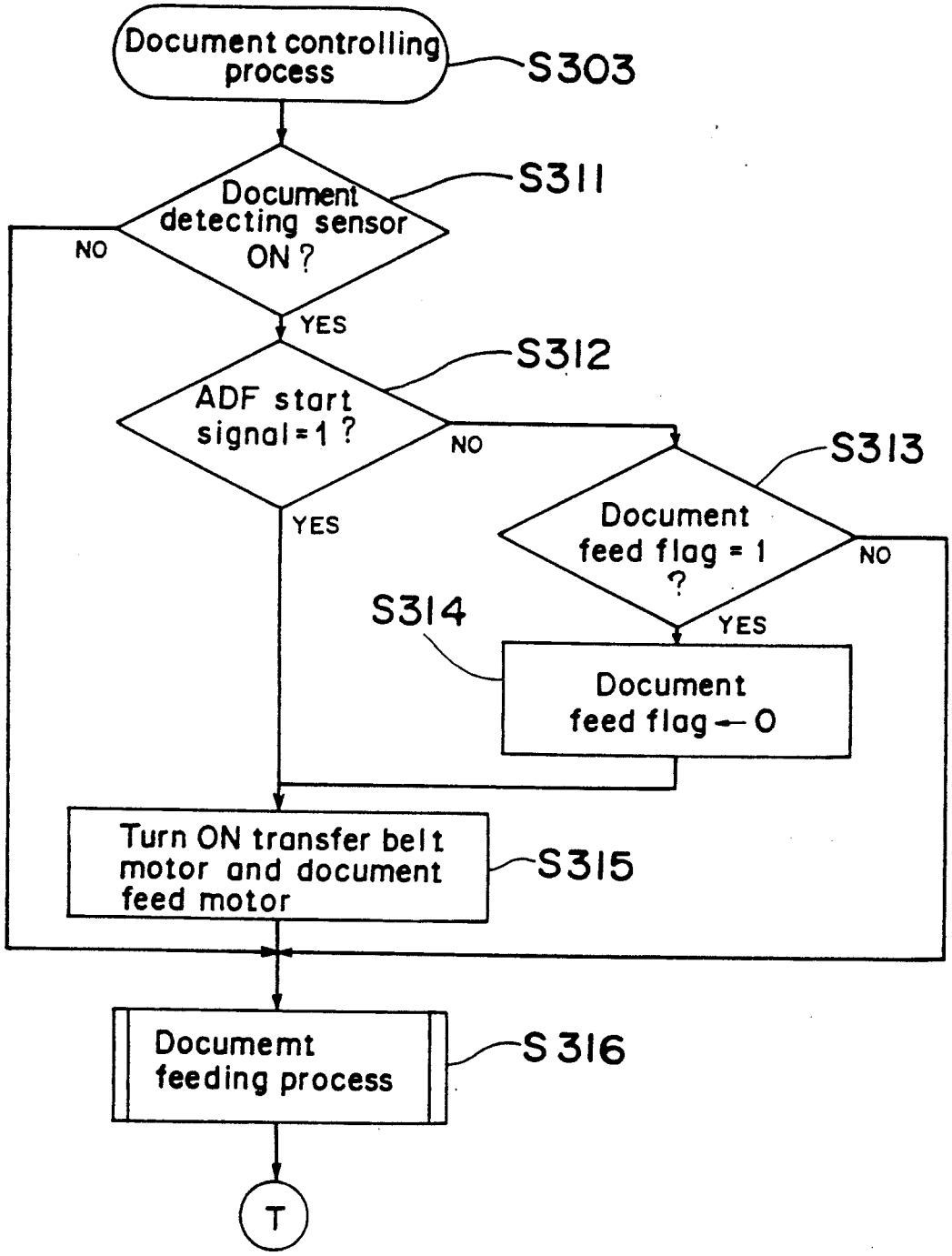
FIGS. 17*a* and 17*b* are flow charts of an original controlling process of FIG. 16.
Figure 17B:
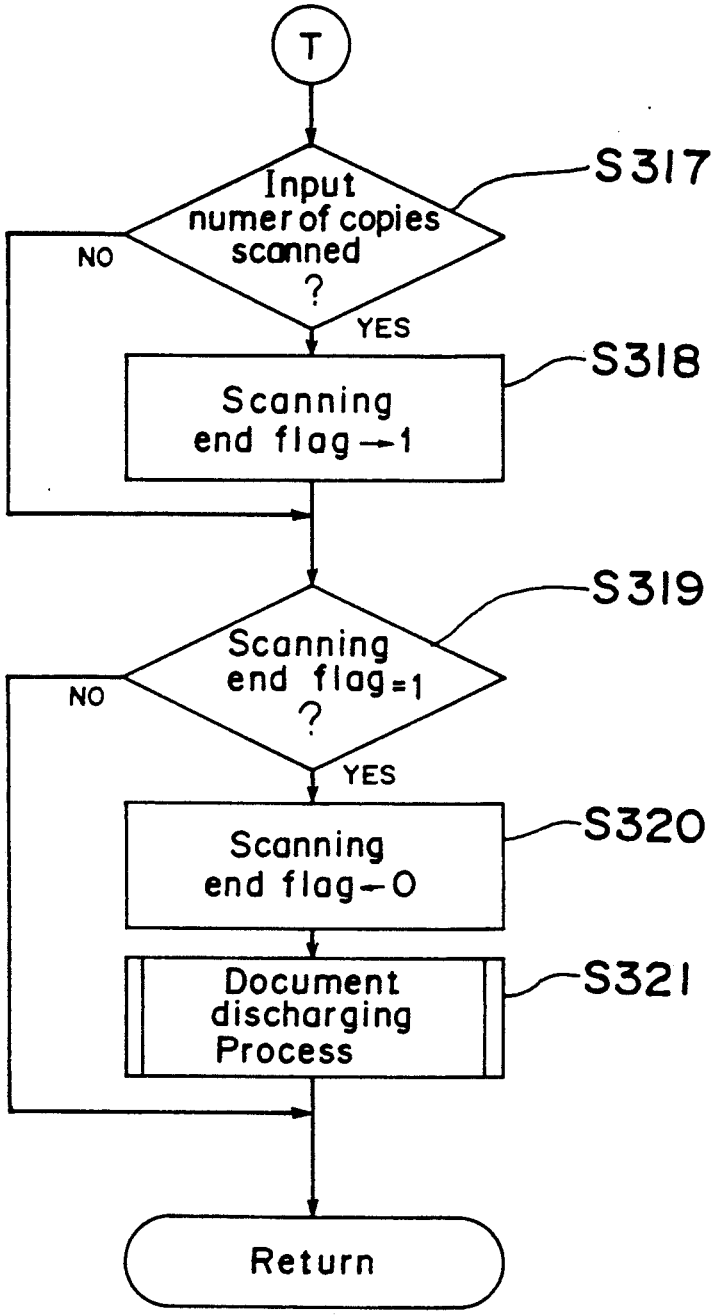

The document controlling process (step S303) shown in FIG. 16 is explained more in detail in a flow chart of FIGS. 17*a* and 17*b*.

It is detected at step S311 of FIG. 17*a* whether the document detecting sensor 311 is turned ON, that is, whether the document is present on the document tray 303. When the document detecting sensor 311 is turned OFF (NO at step S311), the program flow moves to step S316. If the document detecting sensor 311 is in the ON state (YES at step S311), it is detected at step S312 whether an ADF start signal transmitted from CPU 501 to CPU 503 is 1. When the ADF start signal is 1 (YES at step S312), both the transfer belt motor 301 and the document feeding motor 302 are turned ON at step S315 to transfer the document to a predetermined position on the document glass 11. Then, the program flow goes to step S316. If the ADF signal is 0 (NO at step S312), it is checked at step S313 whether a document feed flag is 1. If the document feed flag is 1 (YES at step S313), after the document feed flag is reset to 0 at step S314, the program flow proceeds to step S315. If the document feed flag is 0 (NO at step S313), the program flow skips to step S316.

The document feeding process which will be described later is conducted at step S316. Thereafter, it is checked at step S317 of FIG. 17*b* whether the input number of copies is scanned. When scanning for the input number of copies is completed (YES at step S317), a scanning end flag is set to 1 at step S318 which is followed by step S319. If the set number of copies is not completely scanned (NO at step S317), the program flow goes to step S319 with step S318 omitted.

If it is detected at step S319 that the scanning end flag is 1 (YES at step S319), the scanning end flag is reset to 0 at step S320, and then, a document discharging process described later is carried out at step S321. The program flow returns to the main routine. On the other hand, when the scanning end flag is 0 (NO at step S319), the program flow returns to the main routine directly from step S319.

Figure 18A:
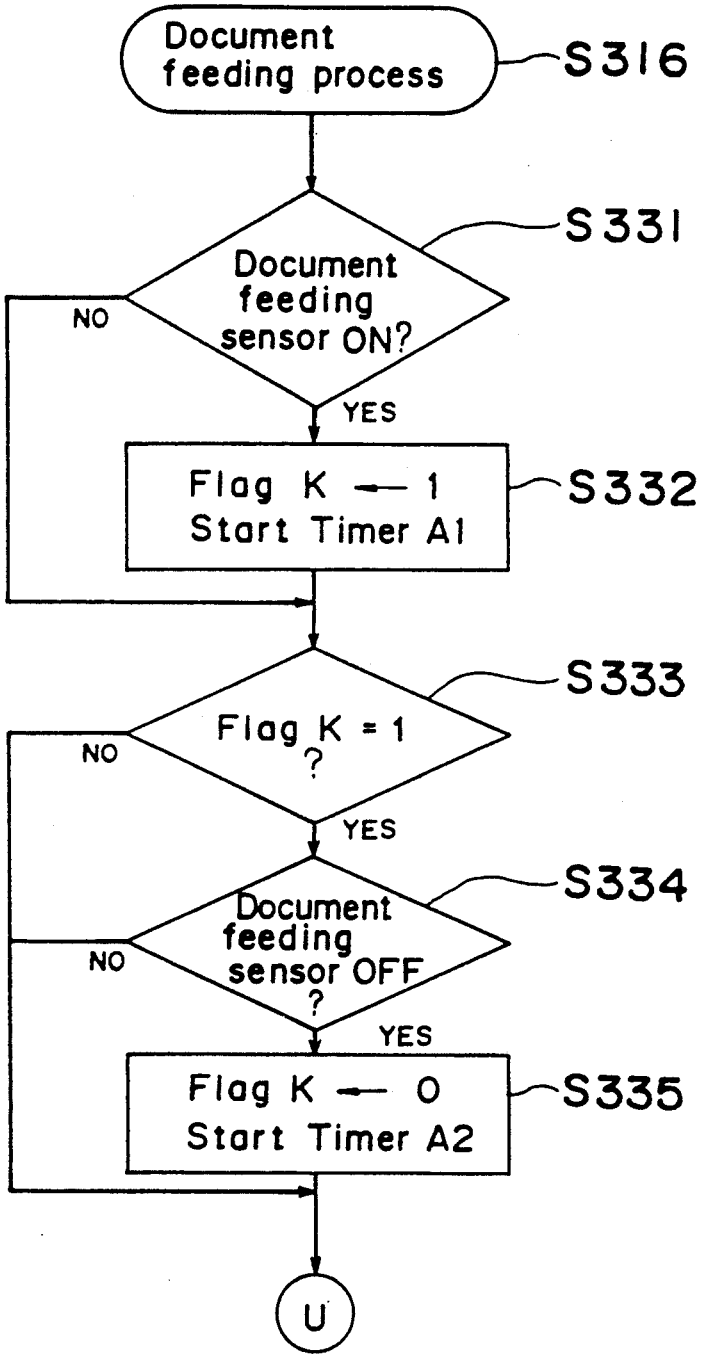
FIGS. 18*a* and 18*b* are flow charts of an original feeding process of FIG. 17*a*.
Figure 18B:
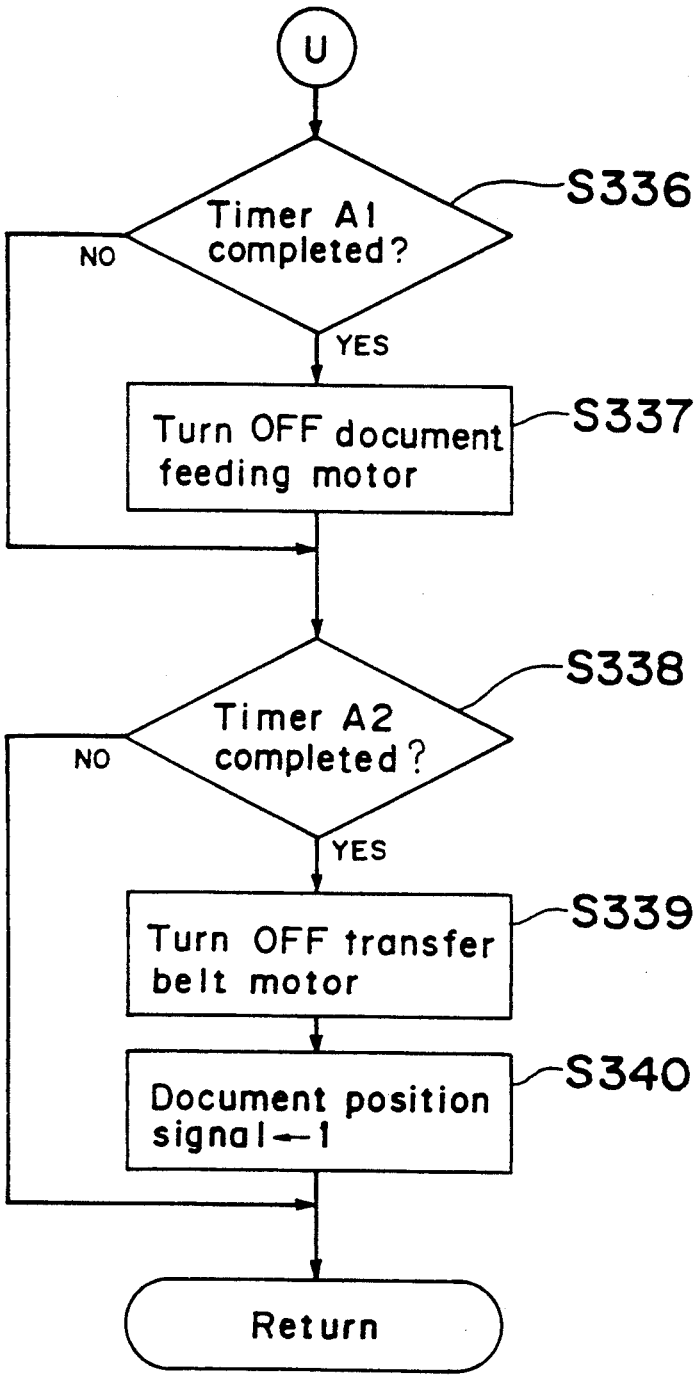

FIGS. 18*a* and 18*b* are flow charts of the above-mentioned document feeding process (step S316) shown in FIG. 17*a*.

First, it is detected at step S331 whether the document feeding sensor 310 is turned ON. When the sensor 310 is turned ON (YES at step S331), a flag K is set to 1 at step S332, and then, after the timer A1 incorporated in CPU 503 is started, the program flow proceeds to step S333. This timer A1 is used to stop the document feeding motor 302 so as to prevent a succeeding document from being supplied. A predetermined time necessary for the document to reach a position whether the document is transferred by the transfer belt 305 is set in the timer A1.

If the document feeding sensor 310 is not turned ON (NO at step S331), the program flow goes to step S333 from step S331.

Thereafter, it is detected at step S333 whether the flag K is 1. Then, it is detected at step S334 if the document feeding sensor is turned OFF. When the flag K is 1 (YES at step S333) and the document feeding sensor 310 is turned OFF (YES at step S334), the flag K is reset to 0 and the timer A2 is started counting at step S335. A time required for a making rear end of the document reach a fixed position arranged on the document glass 11 is set in the timer A2. If the flag K is 0 (NO at step S333) and the document feeding sensor 310 is OFF (NO at step S334), the program flow goes to step S336.

At step S336 of FIG. 18*b*, it is detected whether counting of the timer A1 is finished. When counting of the timer A1 is finished (YES at step S336), the document motor 302 is turned OFF and stopped at step S337, with the program flow going to step S338. Meanwhile, when counting of the timer A1 is not finished (NO at step S336), the program flow directly moves to step S338.

It is checked at step S338 whether counting of the timer A2 is finished. When counting of the timer A2 is finished (YES at step S338), the transfer belt motor 301 is turned OFF at step S339. Then, after the document position signal is set to 1 at step S340, the program flow returns to the original routine. On the other hand, if counting of the timer A2 is not completed (NO at step S338), step S339 is skipped and the program flow goes to the original routine.

Figure 19:
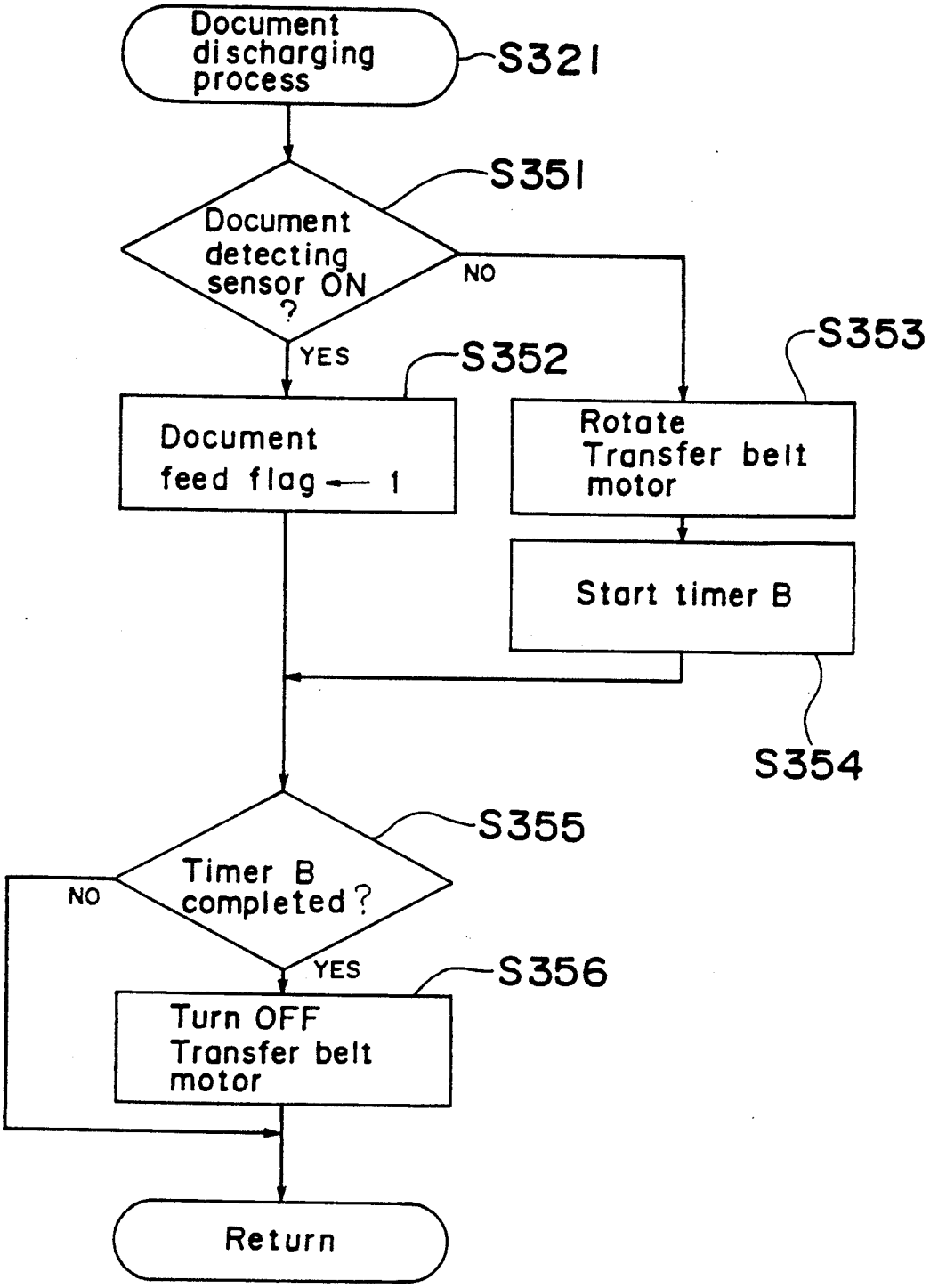
FIG. 19 is a flow chart of an original discharging process of FIG. 17*b*.

FIG. 19 is a flow chart of the document discharging process (step S321) shown in FIG. 17*b*.

It is detected at step S351 whether the document detecting sensor 311 is turned ON, i.e., the document is present on the document tray 303. When the document detecting sensor 311 is turned ON (YES at step S351), the document feeding flag is set to 1 at step S352, and then, the program flow proceeds to step S355. If the document detecting sensor 311 is turned OFF (NO at step S351), the transfer belt motor 301 is turned ON at step 353 and counting of the timer B is started at step S354. The timer B is set with a time required for discharging a document (having the largest length) on the document glass 1.

Whether counting of the timer B is finished is detected at step S355. When counting of the timer B is finished (YES at step S355), the transfer belt motor 301 is turned OFF at step S356, with the program flow returning to the original routine. If counting of the timer B is not finished (NO at step S355), the program flow is returned to the original routine.

Figure 20A:
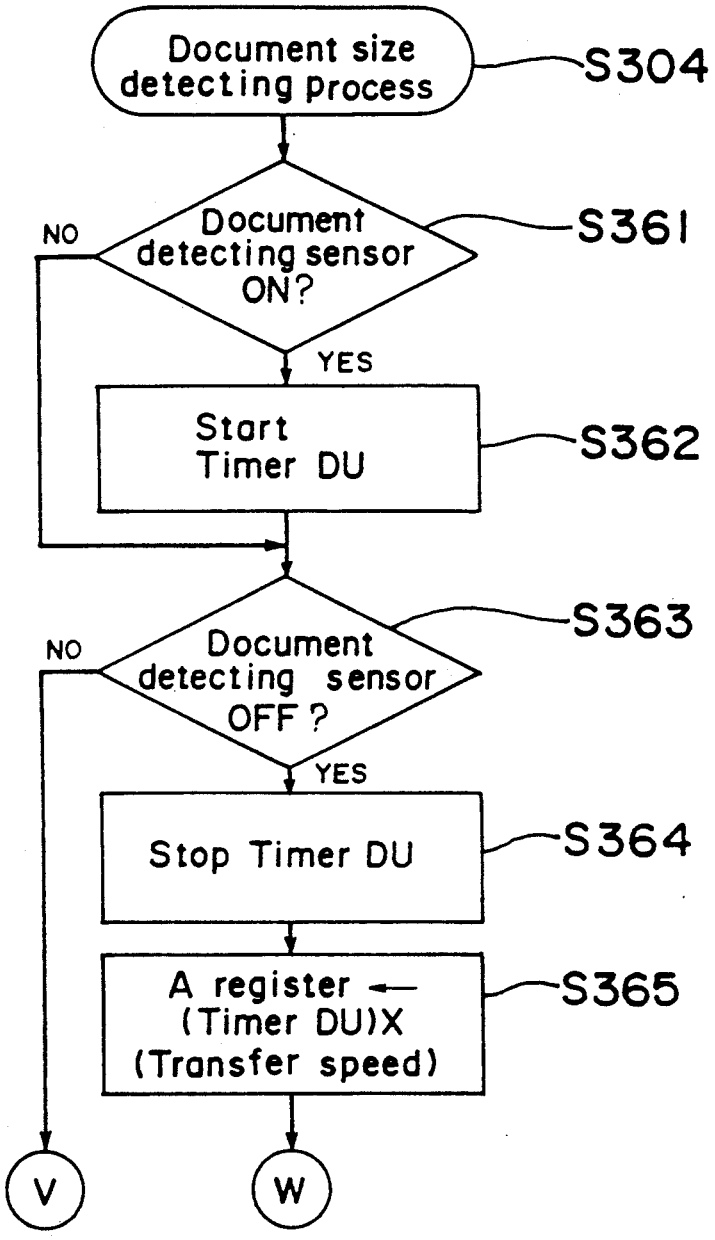
FIGS. 20*a* and 20*b* are flow charts of an original size detecting process of FIG. 16.
Figure 20B:
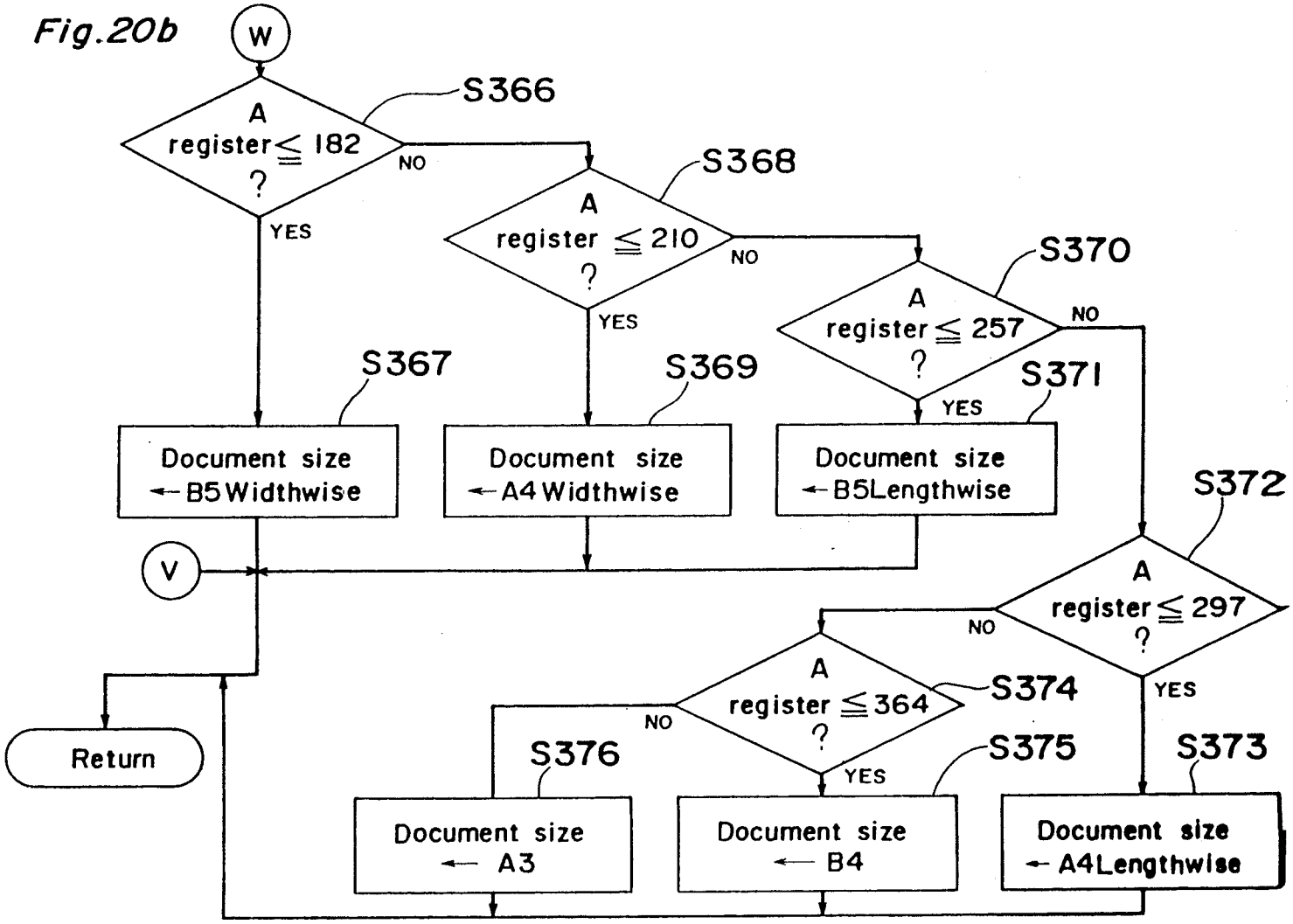

FIGS. 20*a* and 20*b* are flow charts of the document size detecting process (step S304) shown in FIG. 16.

Referring to FIG. 20*a*, it is checked at step S361 whether the document detecting sensor 311 is turned ON. When the sensor 311 is turned ON (YES at step S361), a timer DU provided within CPU 503 is started from 0 at step S362 which leads to step S363. If the document detecting sensor 311 is remained in the OFF state (NO at step S361), the program flow moves to step S363.

Step S363 is provided to detect whether the document detecting sensor 311 is turned OFF. If not (NO at step S363), the program flow returns to the main routine. On the other hand, if the document detecting sensor 311 is turned OFF, i.e., the rear end of the document passes the fixed position (YES at step S363), counting of the timer DU is stopped at step S364. Then, at step S365, data of a value obtained by multiplying the value of the timer DU with a transfer speed of the document, namely, a calculating value (mm) of the length of the document is stored in the A register provided within the CPU 503. The program flow moves to step S366 of FIG. 20*b*.

At steps S366, S368 and S370, respectively, it is detected whether data stored in the A register is not larger than 182 (mm), 210 (mm) and 257 (mm). Specifically, when the data of the A register is a value not larger than 182 (mm) (YES at step S366), "B5 widthwise" is set as the document size at step S367, and then, the program flow is returned to the main routine. Further, when the data of the A register is a value not larger than 210 (mm) (YES at step S368), "A4widthwise" is set as the document size at step S369 and the main routine follows. Furthermore, if the data of the A register is not larger than 257 (mm) (YES at step S370), the document size is set to be "B5 lengthwise" at step S371 and the main routine is resumed.

Meanwhile, if the data of the A register is a value exceeding 257 (mm) (NO in any steps S366, 368 and S370), it is checked at steps S372 and S374 whether the data of the A register is not larger than 297 (mm) and 364 (mm), respectively. When the data of the A register is not larger than 297 (mm) (YES at step S382), "A4 lengthwise" is set as the document size at step S373 and the program flow returns to the main routine. If the data of the A register is not larger than 364 (mm) (YES at step S374), "B4" is set as the document size at step S375, with the program flow returning to the main routine. When data of the A register is a value exceeding 364 (mm) (NO at step S374), "A3" is set as the document size, and then, the program flow returns to the main routine.

In the copying machine of the present embodiment, described in the copying process shown in FIGS. 11*a* to 11*g*, when the elevator 1020 is moving upwards (elevator up signal = 1) without the ADF device 300 used, the copying machine is not set in the paper empty state, unlike the prior art. And, when the LCT 1030 is selected and the print key 721 is depressed, the copying machine is set in the standby state at step S79 (copy standby flag = 1). Consequently, the elevator 1020 is raised to the paper feed position, thereby turning ON the upper surface switch 1002 and turning the elevator up signal to 0 (YES at step S77). At this time, the copy start flag is set to 1 and the copy standby flag is reset to 0 at step S78, and accordingly, the copying operation with the copy papers set in the selected LCT 1030 is started.

In the event ADF device 300 is used, when the LCT 1030 is selected and the print key 721 is depressed, the ADF start signal set to 1 at step S72. When the document reaches a predetermined fixed position by the ADF device 300 (the document position signal being turned to 1, YES at step S75), and also, when the elevator 1020 is raised to the paper feed position thereby turning the elevator up signal to 0 (YES at step S77), the copy start flag is set to 1 and the copy standby flag is reset to 0 at step S78, so that the copying operation with the copy papers set in the selected LCT 1030 is started.

In the foregoing embodiment, the present invention is applied to a copying machine. However, it is possible to apply the present invention to an image forming apparatus such as a printer, etc. whereby an image is formed on a paper through the image forming operation based on the information transmitted from a host computer. In such case, it should be so arranged that it is not discriminated as the paper empty state immediately when a print start signal is inputted from the host computer during the rising time of the elevator, but the printing operation is started if it is not in the paper empty state when the elevator is completely raised.

In the instant embodiment, the paper empty state is detected after the complete rise of the elevator. However, it may be possible to provide a paper detecting sensor on the elevator, so that the presence or absence of the papers on the elevator is detected even during the rise of the elevator. Therefore, the paper empty state can be known if the copy papers are not found on the elevator.

Although the present invention has been fully described in connection with the preferred embodiments thereof with reference to the accompanying drawings it is to be noted that various changes and modifications are apparent to those skilled in the art. Such changes and modifications are to be understood as included within the scope of the present invention as defined by the appended claims unless they depart therefrom.

TABLE 1

| Binary code | | | | Size of paper and | |
|---|---|---|---|---|---|
| SW4 | SW3 | SW2 | SW1 | setting direction | Decimal code |
| 0 | 0 | 0 | 0 | | 0 |
| 0 | 0 | 0 | 1 | | 1 |
| 0 | 0 | 1 | 0 | | 2 |
| 0 | 0 | 1 | 1 | A5 Lengthwise | 3 |
| 0 | 1 | 0 | 0 | B5 Lengthwise | 4 |
| 0 | 1 | 0 | 1 | A4 Lengthwise | 5 |
| 0 | 1 | 1 | 0 | B4 Lengthwise | 6 |
| 0 | 1 | 1 | 1 | A3 Lengthwise | 7 |
| 1 | 0 | 0 | 0 | | 8 |
| 1 | 0 | 0 | 1 | | 9 |
| 1 | 0 | 1 | 0 | B5 Widthwise | 10 |
| 1 | 0 | 1 | 1 | A4 Widthwise | 11 |
| 1 | 1 | 0 | 0 | | 12 |
| 1 | 1 | 0 | 1 | | 13 |
| 1 | 1 | 1 | 0 | | 14 |
| 1 | 1 | 1 | 1 | | 15 |

What is claimed is:

1. An image forming apparatus comprising:

image forming means for forming an image on a sheet of paper;

a paper supporting member for supporting a stack of papers;

elevator means for raising and lowering said paper supporting member;

paper feeding means for deeding a sheet of paper from said paper supporting member to said image forming means;

operating means for instructing said image forming means to start forming an image; and control means for controlling said paper feeding means to start feeding a sheet of paper after said paper supporting member reaches a predetermined position if said operating means instructs during rising of said paper supporting member.

2. The apparatus as claimed in claim 1, further comprising detection means for detecting whether or not there are papers supported by said paper supporting member;

wherein said control means stops said operation of said detection means during rising of said paper supporting member.

3. The apparatus as claimed in claim 1, wherein said paper supporting member is movable between a paper feed position at which a sheet of paper is fed to said image forming means by said paper feeding means, and a paper supply position at which papers are supplied to said paper supporting member, said paper supply position being positioned beneath said paper feed position.

4. The apparatus as claimed in claim 3, wherein said control means controls said paper feeding means to start said paper feeding operation immediately after said paper supporting member reaches said paper feed position.

5. An image forming apparatus comprising:

image forming means for forming an image of a document on a sheet of paper with a predetermined one of plural magnifications;

at least first and second paper feeding means for storing and feeding papers of different sizes, respectively, said first paper feeding means including a paper supporting member for supporting a stack of papers and elevator means for raising and lowering said paper supporting member;

size detection means for detecting a size of said document;

paper size judgment means for judging a paper size suitable for forming said image of said document based on said size of said document detected by said size detection means;

selection means for selecting one of said first and second paper feeding means suitable for forming said image of said document based on said paper size judged by said paper size judgment means; and control means for controlling said image forming means to form said image of said document on a sheet of paper when said image forming means can form said image if said first paper feeding means is selected by said selection means during rising of said paper supporting member.

6. The apparatus as claimed in claim 5, wherein said control means controls said first paper feeding means to start feeding a sheet of paper after rising of said paper supporting member is completed.

7. An image forming apparatus comprising:

image forming means for forming an image of a document on a sheet of paper with a predetermined one of plural magnifications;

at least first and second paper feeding means for storing and feeding papers of different sizes, respectively, said first paper feeding means including a paper supporting member for supporting a stack of papers and elevator means for raising and lowering said paper supporting member;

selection means for selecting either one of said first and second paper feeding means; and control means for controlling said paper feeding means to start feeding a sheet of paper immediately after said paper supporting member reaches a predetermined position if said first paper feeding means is selected by said selection means during rising of said paper supporting member.

8. The apparatus as claimed in claim 7, further comprising detection means for detecting whether or not papers are supported by said paper supporting member, wherein said control means stops said operation of said detection during rising of said paper supporting member.

9. An image forming apparatus comprising:

a paper supporting member for supporting a stack of papers;

paper feeding means for feeding a sheet of paper from said paper supporting member;

moving means for moving said paper supporting member bi-directionally between a first position and a second position at which a sheet of paper is fed by said paper feeding means;

operating means for instructing said paper feeding means to feed a sheet of paper; and control means for controlling said paper feeding means to wait for said paper supporting member to reach the second position if an instruction of said operating means is generated during the movement of said paper supporting member from the first position to the second position and to start feeding a sheet of paper after the paper supporting member reaches the second position.

* * * * *